US005772208A

United States Patent [19]

McTaggart

[11] Patent Number: 5,772,208

[45] Date of Patent: Jun. 30, 1998

[54] GAME BOARD INCORPORATING APPARATUS FOR SELECTIVELY PROVIDING SENSORY GAME ENHANCEMENT AND METHOD FOR MAKING THE SAME

[76] Inventor: Stephen I. McTaggart, 12037 N. 62nd Pl., Scottsdale, Ariz. 85254

[21] Appl. No.: 554,734

[22] Filed: Nov. 7, 1995

[51] Int. Cl.[6] ..... A63F 3/00

[52] U.S. Cl. ..... 273/237

[58] Field of Search ..... 273/237, 238

[56] References Cited

U.S. PATENT DOCUMENTS

| | | |
|---|---|---|
| Re. 28,199 | 10/1974 | Deb et al. . |
| 1,475,430 | 11/1923 | Curwen . |
| 1,545,217 | 7/1925 | Thurber . |
| 1,670,254 | 5/1928 | Gowin . |
| 2,277,318 | 3/1942 | Grant . |
| 2,444,355 | 6/1948 | Kniznick . |
| 2,524,143 | 10/1950 | Smith . |
| 2,826,844 | 3/1958 | Leika . |
| 2,997,306 | 8/1961 | Hicks . |
| 3,086,297 | 4/1963 | Kantrowitz . |
| 3,096,271 | 7/1963 | Hespenheide . |
| 3,220,126 | 11/1965 | Gabrielsen . |
| 3,522,665 | 8/1970 | Kalt . |
| 3,529,832 | 9/1970 | Goetz et al. . |
| 3,540,132 | 11/1970 | Glass et al. . |
| 3,553,851 | 1/1971 | Paige . |
| 3,592,098 | 7/1971 | Zadig . |
| 3,648,387 | 3/1972 | Lahr . |
| 3,738,021 | 6/1973 | Hino et al. . |
| 3,798,806 | 3/1974 | Sanford . |
| 3,803,580 | 4/1974 | Shattuck . |
| 4,021,932 | 5/1977 | Lipps . |
| 4,044,229 | 8/1977 | Samreus . |
| 4,055,014 | 10/1977 | Schmidt et al. . |
| 4,102,067 | 7/1978 | Tarrant . |
| 4,158,264 | 6/1979 | Orth . |
| 4,189,852 | 2/1980 | Chatlien . |
| 4,209,824 | 6/1980 | Kaufman . |
| 4,222,188 | 9/1980 | Tarrant et al. . |
| 4,236,156 | 11/1980 | Eden . |
| 4,273,538 | 6/1981 | Ross . |
| 4,286,399 | 9/1981 | Funahashi et al. . |
| 4,299,041 | 11/1981 | Wilson . |
| 4,363,081 | 12/1982 | Wilbur . |
| 4,425,098 | 1/1984 | Döring . |
| 4,497,126 | 2/1985 | Dejean . |
| 4,531,310 | 7/1985 | Acson et al. . |
| 4,636,881 | 1/1987 | Brefka et al. . |
| 4,656,469 | 4/1987 | Oliver et al. . |
| 4,703,573 | 11/1987 | Montgomery et al. . |
| 4,706,536 | 11/1987 | Sanders . |
| 4,733,127 | 3/1988 | Takasu et al. . |
| 4,752,230 | 6/1988 | Shimizu . |
| 4,778,391 | 10/1988 | Weiner . |
| 4,809,246 | 2/1989 | Jeng . |
| 4,818,827 | 4/1989 | Ipcinski et al. . |
| 4,990,092 | 2/1991 | Cummings . |
| 5,209,665 | 5/1993 | Billings et al. . |
| 5,290,190 | 3/1994 | McClanahan . |
| 5,356,296 | 10/1994 | Pierce et al. . |

*Primary Examiner*—William E. Stoll
*Attorney, Agent, or Firm*—Quarles & Brady

[57] ABSTRACT

An electronic game board includes a foldable sheet, each side of which is divided into first and second sections. On one side, a conductive ink printed circuit, including a plurality of switch contact pads, is laid down such that upper contacts register with lower contacts to effect a switch pair when the sheet is folded. A spacer expedient of dielectric ink, thicker than the conductive ink, is employed to juxtapose the upper and lower contacts of each switch pair in a normally-open condition such that finger pressure selectively effects a momentary closure. The printed circuit also includes traces coupling all the contacts to a decoder which senses if a switch pair is closed. A game board layout is provided on the second side of the sheet and includes indicia identifying the position of each underlying switch pair to be used in the performance of a game to be played in accordance with the game board layout. Signal producing apparatus, such as a sound unit, responds to the closure of a given switch pair by issuing an appropriate, predetermined signal passage. In order to permit folded storage of the game board, one section is bifurcated by a slot which facilitates a temporary fold.

117 Claims, 10 Drawing Sheets

GAME BOARD INCORPORATING APPARATUS FOR SELECTIVELY PROVIDING SENSORY GAME ENHANCEMENT AND METHOD FOR MAKING THE SAME

FIELD OF THE INVENTION

This invention relates to the art of game boards and, more particularly, to game boards including electronic enhancements such as selectively enabled, contextually-meaningful sensory signals; e.g., audible messages, commentary, interpretation, explanation and the like.

BACKGROUND OF THE INVENTION

Board games—played on a game board—have long been a favorite pastime and continue to enjoy ongoing popularity. In recent years, certain commercially available games played on game boards have included various electrical/electronic enhancements generally employing conventional switch structure which is adjacent to, or only rudimentarily incorporated into, the game board structure. While this feature provides entertaining enhancements to board games, the actual integration of the switch structure into the game board itself has not been completely successfully accomplished in the prior art. As a result, the switch structure and the accompanying electrical/electronic components have correspondingly been relatively unattractive, poorly integrated, unreliable and expensive to fabricate. It is to addressing and solving these and other drawbacks of the electrical board game prior art that the present invention is directed.

OBJECT OF THE INVENTION

It is therefore a broad object of this invention to provide an improved game board.

It is a more specific object of this invention to provide an improved game board which incorporates electrical switching structure and electronic apparatus responsive to the actuation of a selected integral switch for issuing a predetermined audible message.

In another aspect, it is an object of this invention to provide such an improved game board in which the electrical switching structure is unobtrusively incorporated into the game board structure.

In yet another aspect, it is an object of this invention to provide such an improved game board which is simple and economic to fabricate and which enjoys long and reliable life in use.

SUMMARY OF THE INVENTION

Briefly, these and other objects of the invention are achieved by providing a game board which includes a foldable sheet, each side of which is divided into first and second sections. On one side, a conductive printed circuit, including a plurality of switch contact pads, is laid down, the contact pads on the first section constituting a plurality of upper contacts and the contact pads printed on the second section constituting a plurality of lower contacts. The upper and lower contact pads are positioned such that, when the sheet is folded along a predetermined line to bring the first and second sections into face-to-face relationship, each of the upper contacts registers with one of the lower contacts to effect a switch pair.

A spacer expedient is employed to juxtapose the upper and lower contacts of each switch pair in a normally spaced-apart relationship to define a normally-open condition whereby finger pressure applied to the second side of the foldable sheet above a given upper contact deflects it downwardly into conductive contact with the its corresponding lower contact, thereby effecting a momentary closure of the switch pair. In a presently preferred embodiment, the printed circuit, including the contact pads, is printed of conductive ink, and the spacer expedient is a suitably distributed printed deposit of dielectric ink disposed, in the regions proximate the contact pads, more or less peripherally about each lower contact pad, the dielectric deposit being thicker than the lower printed circuit pads which are therefore held normally spaced apart from the upper contact pads as mentioned above.

A game board layout is provided (by direct printing or by overlaying a separately prepared sheet) on the second side of the foldable sheet and includes indicia identifying the position of each underlying switch pair to be used in the performance of a game to be played in accordance with the game board layout.

The printed circuit also includes traces which electrically couple all the upper and lower contacts to a decoder which is adapted to sense if a switch pair is closed and, if so, which switch pair. Sound producing apparatus is provided to respond to the closure of a given switch pair by issuing an appropriate, predetermined audible passage. The sound producing apparatus is preferably housed in a control unit which also includes the decoder and a battery.

In order to permit folded storage of the game board, one section may be bifurcated by a slot which facilitates a temporary fold, particularly when stiffener substrates are employed under the section halves to render the structure more rigid and sturdy.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

Figure 1:
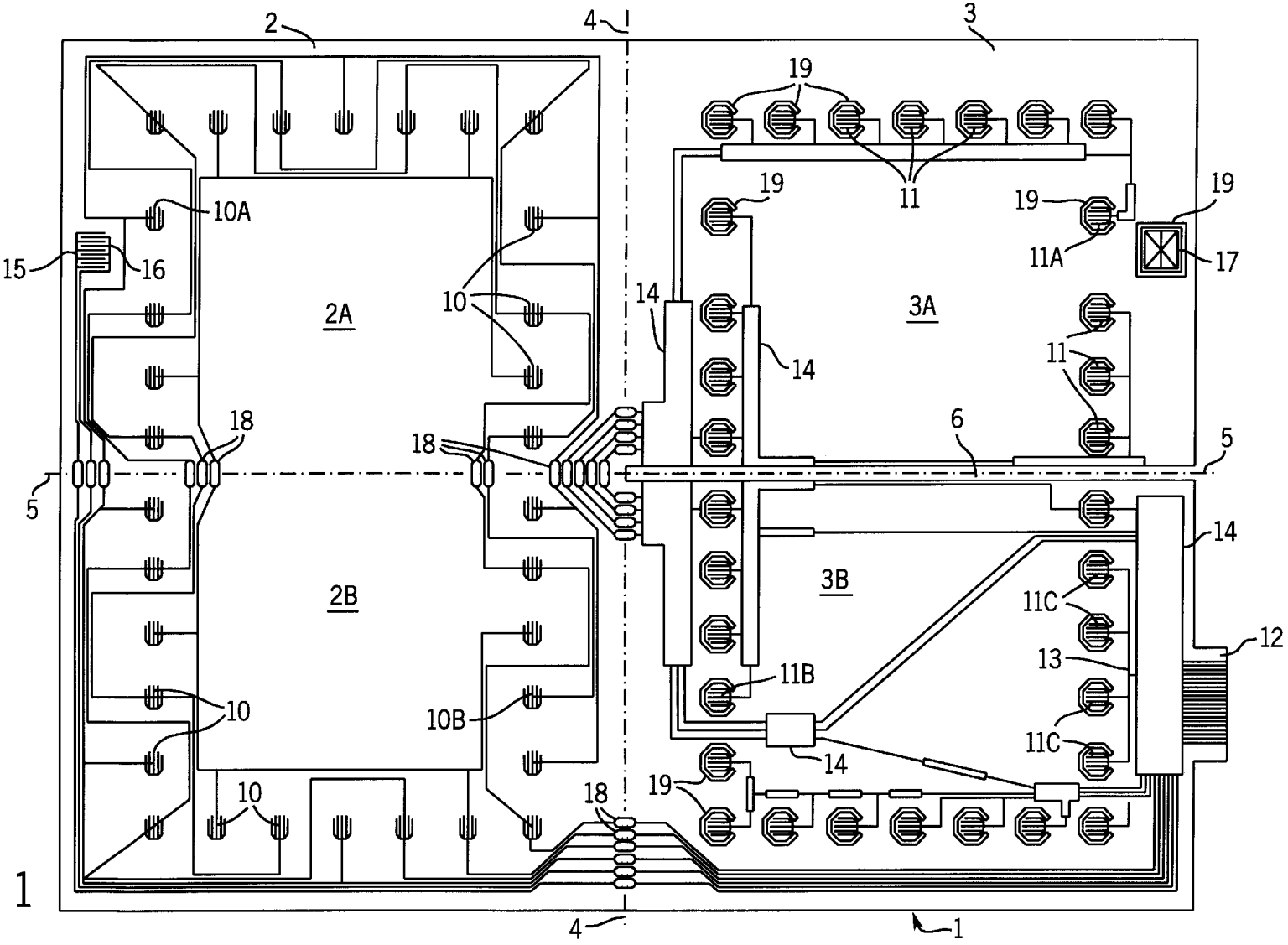
FIG. 1 is a plan view of an obverse side of a foldable sheet component of the invention, shown before a fold is made during the game board fabrication process.
Figure 2:
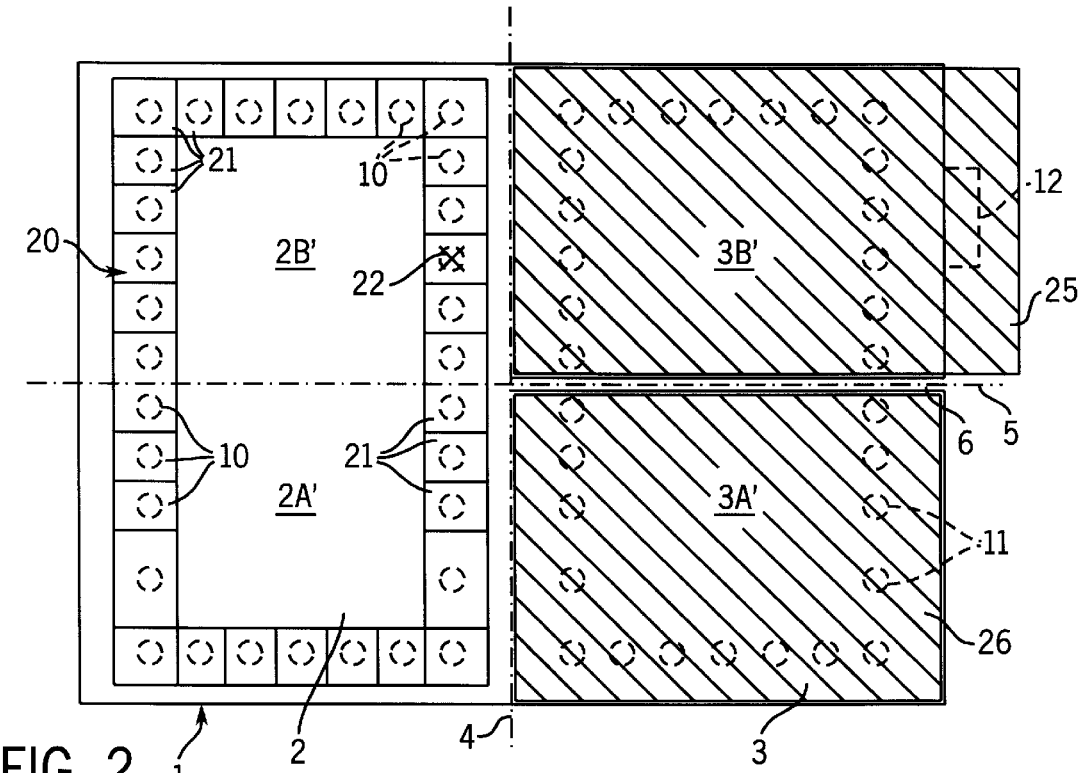
FIG. 2 is a plan view of the reverse side of the foldable sheet illustrated in FIG. 1 showing certain indicia and structure on such reverse side.
Figure 5:
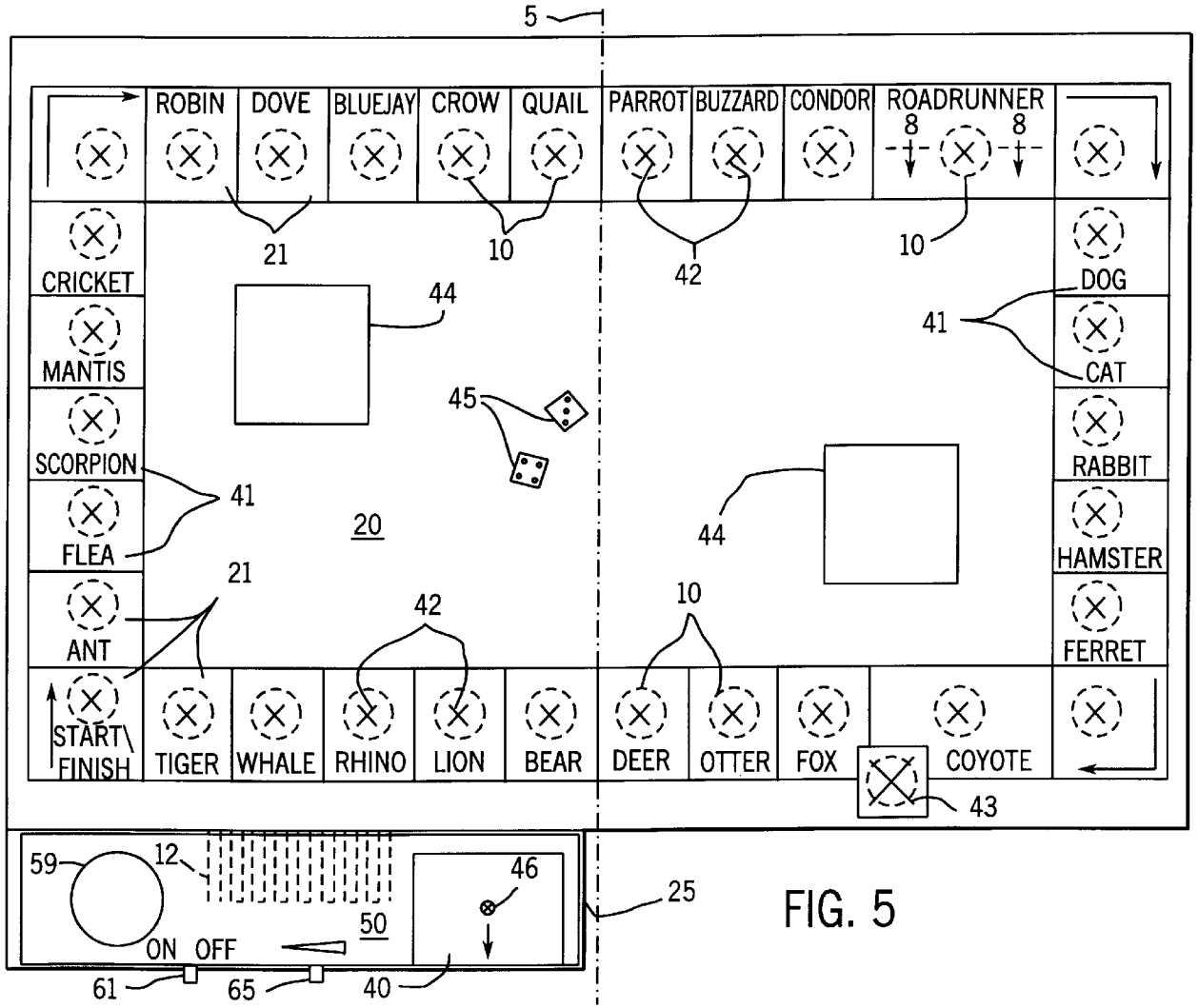
FIG. 5 is a top plan view of a completed game board according to the invention.
Figure 8:
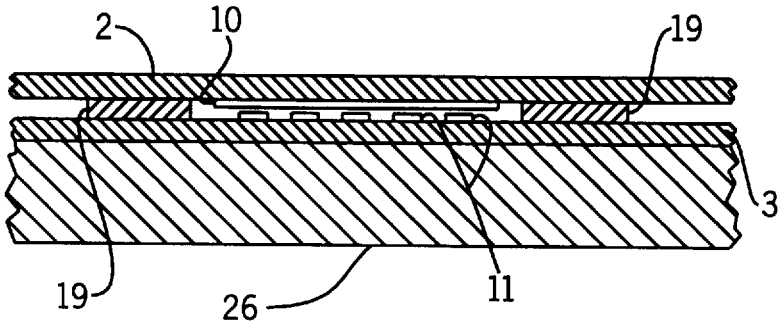
Figure 9:
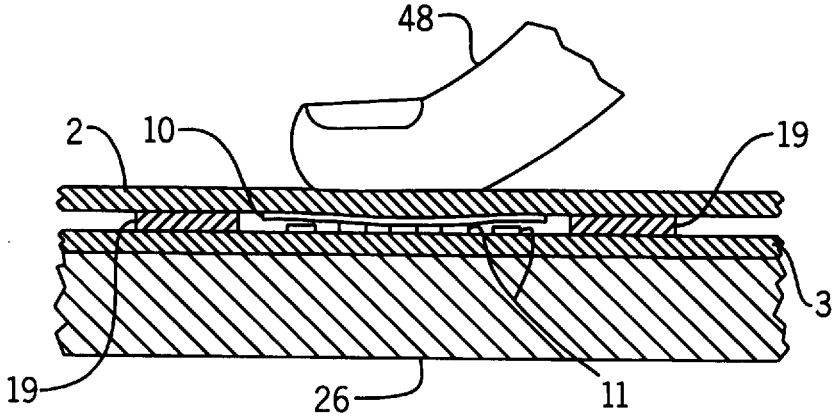
Figure 14:
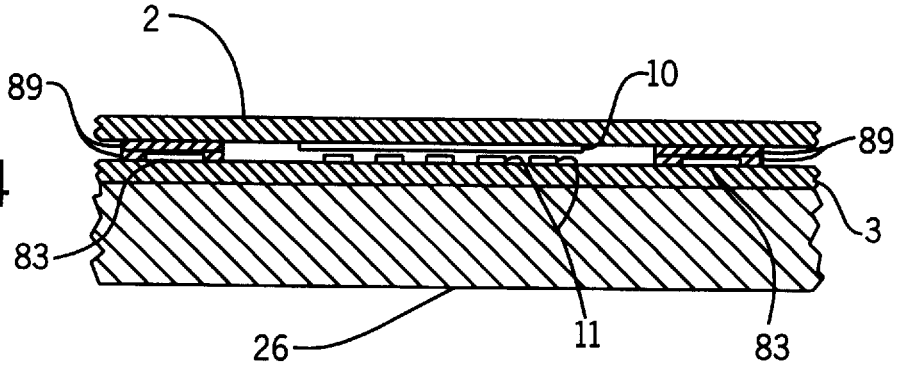
Figure 10:
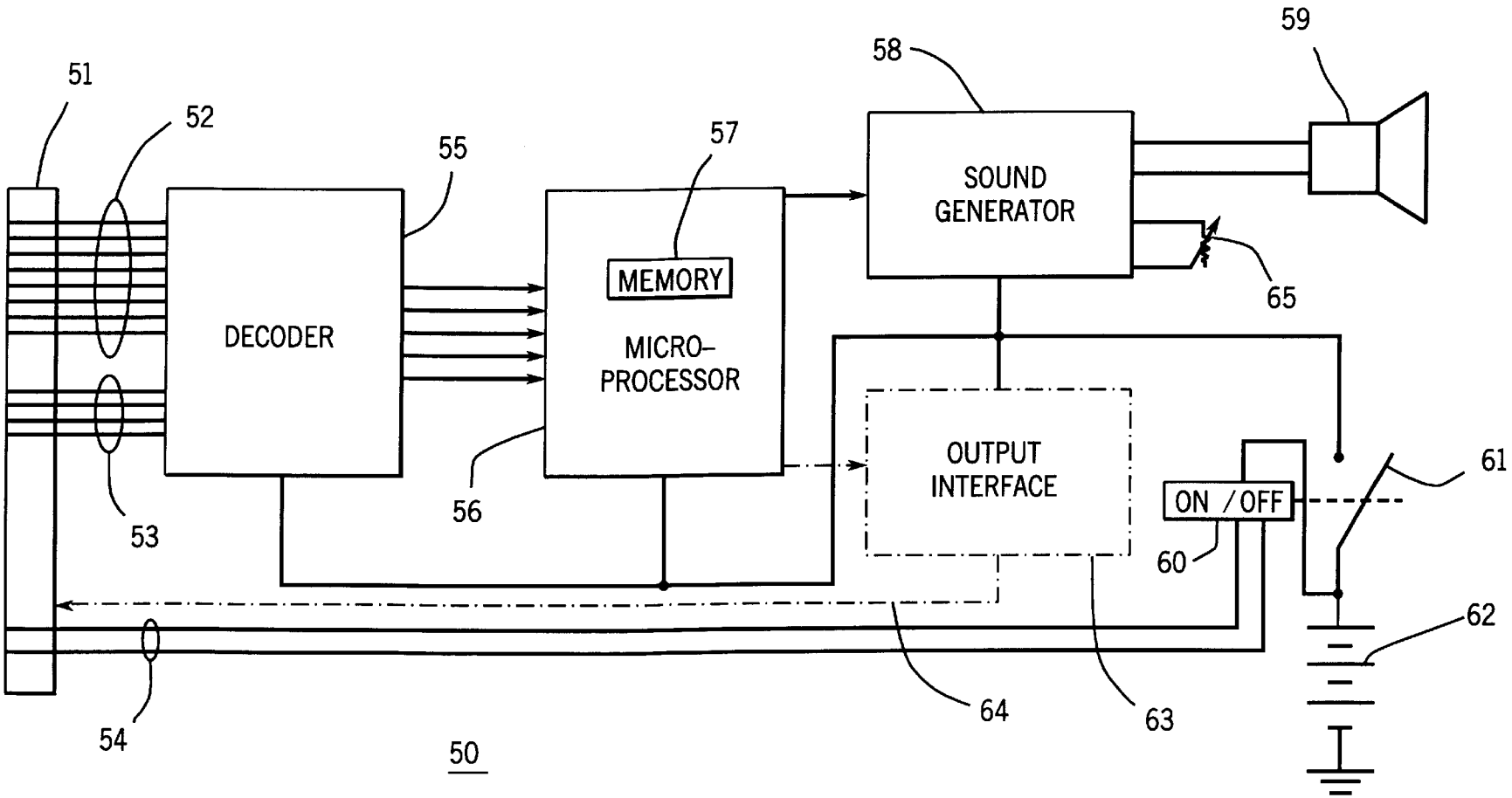
Figure 11:
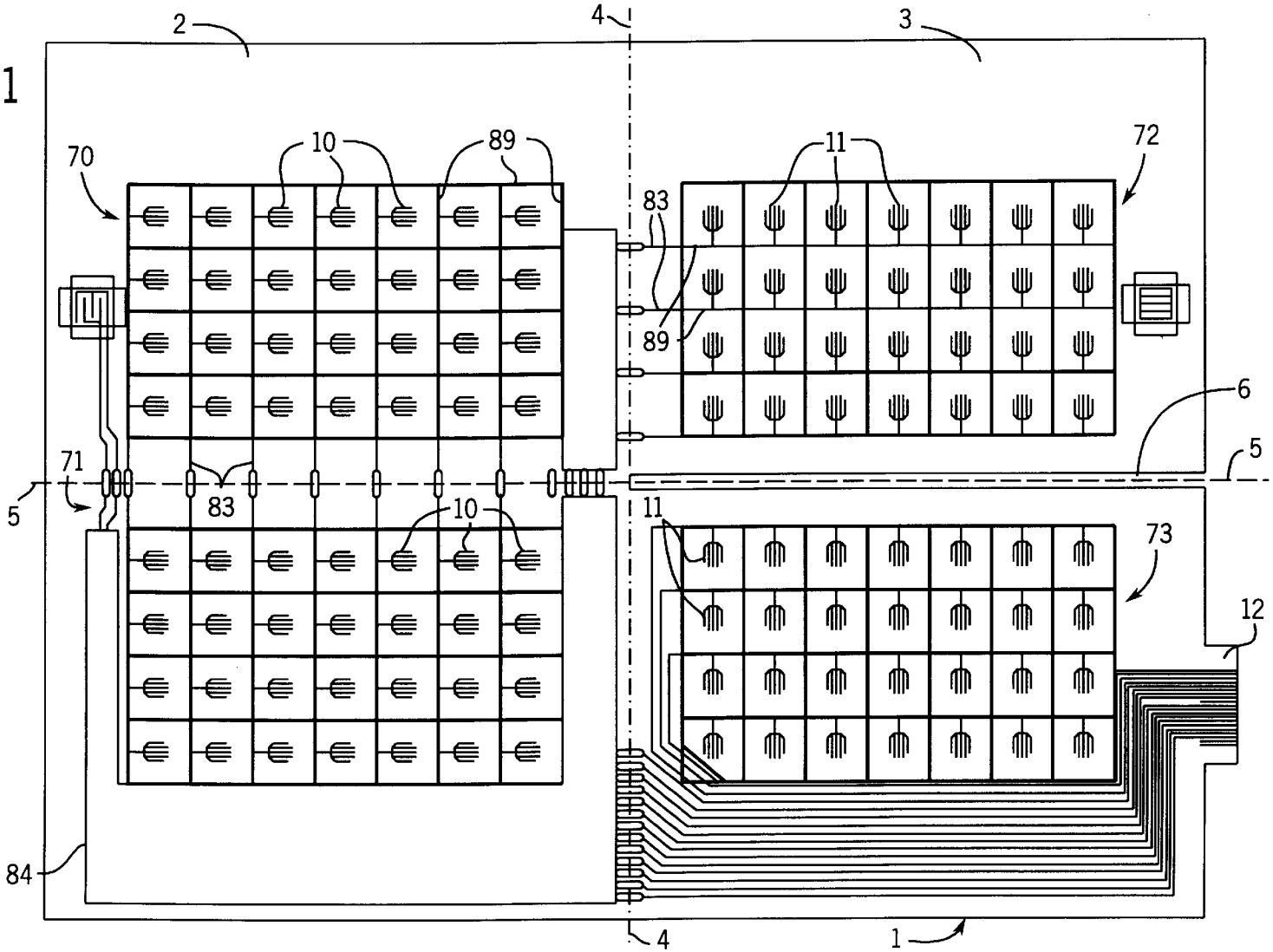
Figure 12:
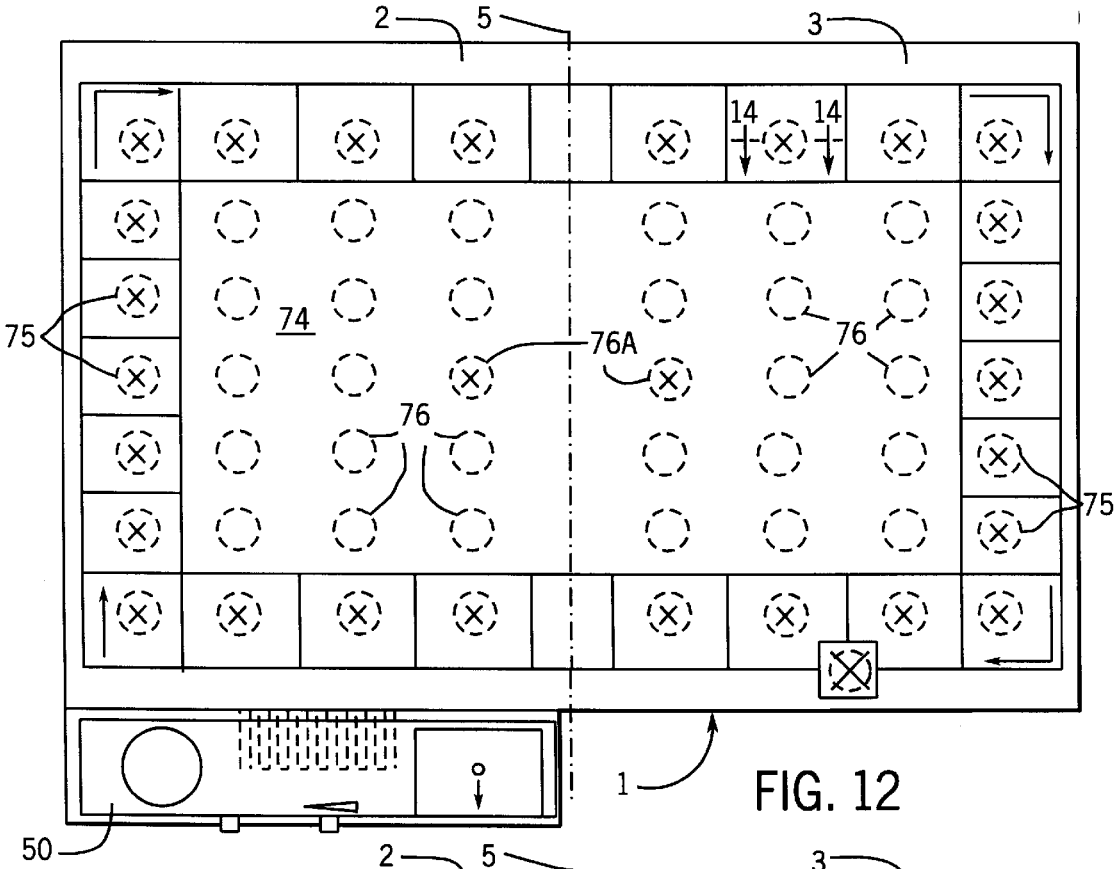
Figure 13:
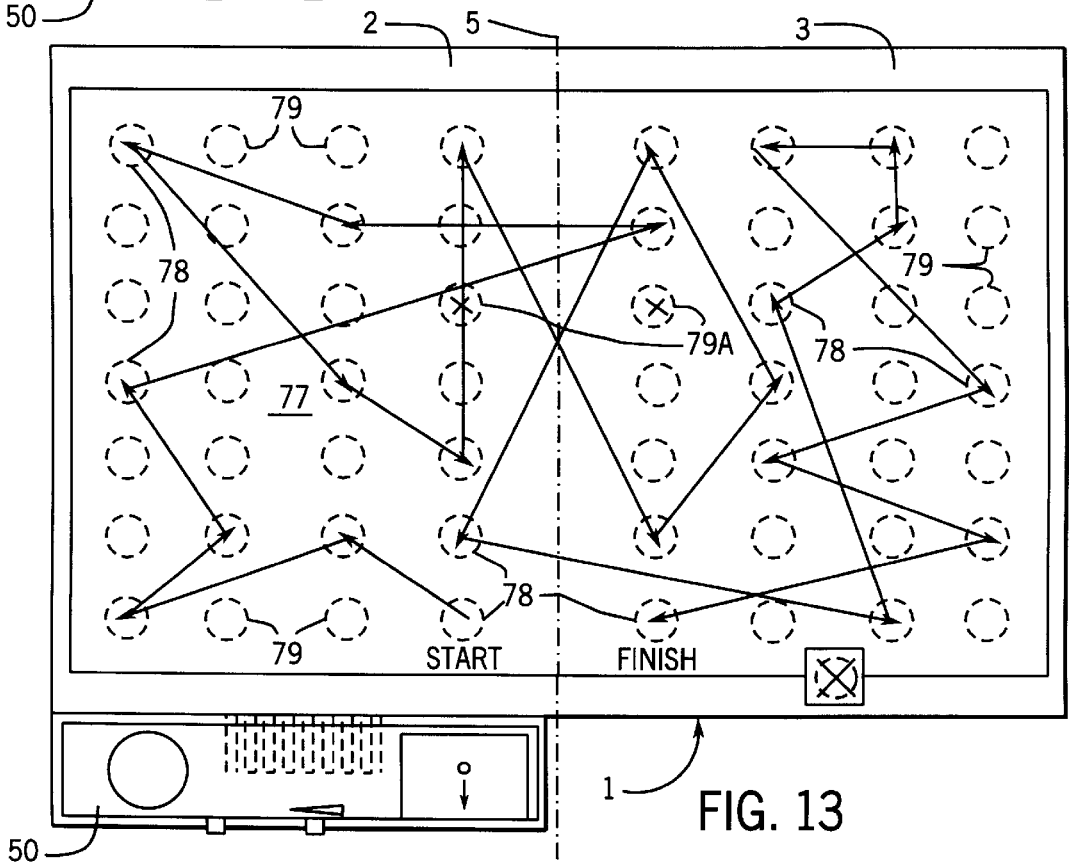
Figure 15:
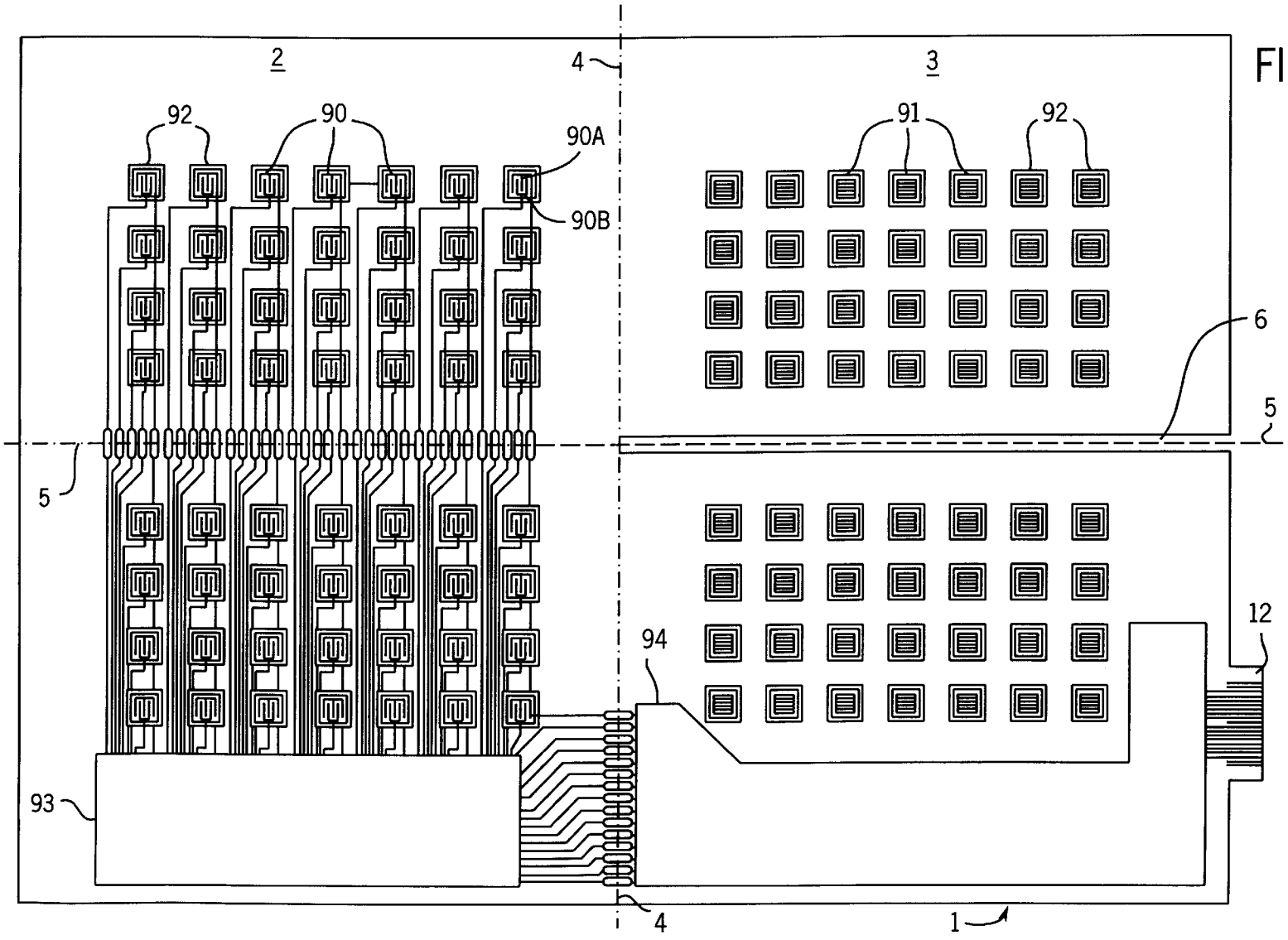

to FIG. 8 is a cross-sectional view taken along the lines 8—8 of FIG. 5 and illustrates the relationship among several constituents of a switch structure;

FIG. 9 is a view similar to FIG. 8 illustrating the switch structure in a momentarily actuated condition;

FIG. 10 is a block diagram of a control unit component of the invention;

FIG. 11 is a view similar to FIG. 1 of a variant, generic embodiment of the circuit layout used in the invention;

FIG. 12 is similar to FIG. 2 showing first representative indicia and structure on the reverse side of the variant, generic embodiment of the invention;

FIG. 13 is similar to FIG. 12, but shows second representative indicia and structure on the reverse side of the variant, generic embodiment of the invention;

FIG. 14 is a cross sectional view similar to FIG. 8 taken along the lines 14—14 of FIG. 12; and FIG. 15 is a view similar to FIGS. 1 and 11 illustrating another variant embodiment of the circuit layout used in the invention.

DESCRIPTION OF THE PREFERRED EMBODIMENT(S)

Referring first to FIG. 1, there is shown the obverse side of a foldable sheet 1 made, for example, from heavy paper stock. The obverse side is divided into a first section 2 and a second section 3 along an imaginary fold line 4. The first and second sections are further divided into section halves, 2A, 2B and 3A, 3B, respectively, along a second imaginary fold line 5. A slot 6 bifurcates the second section 3 from its outer edge 7 along the fold line 5 to the fold line 4. Thus, section halves 3A, 3B are independently foldable along the fold line 4.

A printed circuit is laid onto the obverse side of the sheet 1 by any convenient means. In a presently preferred embodiment of the invention, the printed circuit is printed on the sheet 1 employing conductive ink. The printed circuit includes a plurality of upper contact pads 10 disposed on the first section 2. The upper contact pads are distributed in a pattern appropriate to the layout of a given game as will be more fully described below. A corresponding plurality of lower contact pads 11 are similarly provided on the second section 3.

Referring briefly also to FIG. 8, the contact pads 10, 11 are positioned such that, when the sheet 1 is permanently folded along the fold line 4 during the game board fabrication process to bring the obverse sides of the first section 2 and the second section 3 of the sheet 1 into face-to-face relationship, each upper contact 10 will register with a lower contact 11 to provide a switch pair. For example, contact pads 10A and 11A in FIG. 1 will register and become a switch pair; similarly, contact pads 10B and 11B will become a switch pair and so on. The structural details shown in FIG. 8 will be discussed more fully below.

The printed circuit also includes a trace pattern which couples groups of the contact pads to a connector 12 which may conveniently be integral with sheet 1 and the printed circuit to facilitate connection to a control unit (not shown in FIG. 1) as will be discussed in more detail below. Thus, by way of example, a group of four lower contact pads 11C are connected together and to one terminal on the connector 12 via trace 13. Similarly, eight upper contact pads 10C are connected together and to another terminal on the connector 12 via trace 14. In the example shown in FIG. 1, thirty-two lower contact pads are connected into eight groups of four contact pads each, and thirty-two upper contact pads are connected into four groups of eight contact pads each. Those skilled in the electrical matrix art will recognize a simple four-by-eight switch matrix from which a switch closure can be uniquely identified by a conventional decoder according to its address in the matrix, all as will be more fully explained below.

A pressure sensitive "on/off" switch on the game board may similarly be provided within or independent of the matrix of switches. For example, upper power switch contact pair 15, 16 will register with lower power switch contact pad 17 when the first section 2 and the second section 3 of the sheet 1 are permanently folded into face-to-face relationship during the game board fabrication process. It may be noted that, in the example, the lower power switch contact pad 17 serves only to bridge the conductive traces of the upper power switch contact pair 15, 16 when finger pressure is applied to the relevant region as will be explained further below. Thus, the two traces from the upper power switch contact pair 15, 16 are independently connected to the connector 12 to provide the pressure responsive "on/off" function. As previously mentioned, the power switch contact pair could alternatively be included in the matrix of switches as will be discussed in detail below in conjunction with the description of FIG. 15.

It will be observed that the relevant traces of the printed circuit are spread into short, broad trace segments 18 at positions at which the imaginary fold lines 4, 5 are crossed. It has been found that this feature significantly improves the reliability of the printed circuit in the regions of actual folds along the fold lines 4, 5, particularly over a period of time during which the game board may be repeatedly folded and unfolded along the fold line 5 as will be described below. There are two related reasons for this result; first, if there is any partial separation of a trace at a fold over a period of time, there is adequate reserve cross-section to maintain the continuity of the circuit; second, and more importantly, a fold tends to compress the conductive structure at the flex line which locally increases the resistance of the trace, the increased cross-section, however, compensating for this effect such that the resistance of a complete trace having fold crossings remains within electrical tolerance.

A resistive layer, generally indicated by shading in FIG. 1 and more fully identified below, is selectively deposited over parts of the conductive printed circuit and in other regions on the obverse side of the section 3 of the foldable sheet 1. This resistive layer has two diverse purposes. First, it serves to conventionally isolate the conductive traces on the two sections 2, 3 of the foldable sheet 1 when the sheet is permanently folded along the fold line 4 during the game board fabrication process. Representative areas are identified by the reference character 14 in FIG.1.

Second, it will be observed that each of the lower contact pads 11 is at least partially circumscribed by a resistive deposit 19. This is an important feature of the switch structure which includes an upper contact pad, as at 10A, and a lower contact pad, as at 11A, after the sheet 1 has been permanently folded along the line 4 during the fabrication process. Detailed analysis of the resulting switch structure and the cooperative characteristics of the conductive and resistive layers will be presented below in conjunction with a discussion of FIGS. 8 and 9.

Attention is now directed to FIG. 2 which shows the reverse side of the foldable sheet 1. Thus, the reverse side of the first section 2 of the foldable sheet is divided into section halves 2A', 2B', and the reverse side of the second section 3 is divided into section halves 3A', 3B' which are bifurcated by the slot 6 as previously described. It will be apparent that section halves 2A', 2B', 3A', 3B' are respectively disposed back-to-back with section halves 2A, 2B, 3A, 3B, the numbered letter designations referring to the section half faces on the two sides of the foldable sheet 1.

Overlaying the reverse side of the second section 2 of the sheet 1 is a game board layout generally indicated at 20. A very simple game board layout is shown and constitutes a rectangular path for advancing tokens along designated increments, represented by contiguous small rectangles 21, according to the rules of a given board game. The upper contact pads 10 are suitably positioned according to the strategic points of the given game. In the example, one upper contact pad is situated immediately beneath each path increment 21. Conveniently, a more precise position for each upper contact pad may be indicated by an "X", as shown at 22 or by other suitable indicia.

The game board layout shown in FIG. 2 is, of course, only exemplary, and it will be understood that the path along which tokens may be advanced may have, for any given board game, regularly or irregularly-spaced increments. Further, the path for tokens can, itself, be irregular rather than regular, and it also is contemplated that some switch positions for a given board game may fall outside a token path. Still further, the invention is not limited to board games contemplating a path for advancing tokens, but may be adapted to any board game in which it is desired to generate an audible message/passage in response to finger pressure applied at an indicated point in the game board layout.

The game board layout may be applied to the reverse side of the first section of the foldable sheet 1 by direct printing or by other direct application methods such that the game board layout is integral with the sheet 1. Alternatively, the game board layout may be separately printed or otherwise laid down on a separate sheet 23 (FIG. 3) which is subsequently affixed, in proper registration with respect to the upper switch contact pads 10, to the reverse side of the first section 2 of the foldable sheet 1 by an adhesive or other conventional expedient.

Because the sheet 1 is foldable, it may not have a great deal of inherent stiffness. On the other hand, it is desirable for a game board to have a certain amount of stiffness, both for durability and, especially, for ease of playing whereby tokens or other accessories will stay in place as a game progresses. Suitable stiffness may be obtained by overlaying the reverse side of each section half of second section 3 of the sheet 1 with a stiffening substrate such as stiffeners, 25, 26, respectively. The stiffener 26 substantially covers the reverse side of section half 3A'; however, preferably, the stiffener 25 extends outwardly beyond the section half 3B' in the direction of connector 12 in order to provide support for a control unit which may be connected to printed circuit via the connector 12 as will be described below. It will be observed that the stiffeners 25, 26 preferably do not abut in their facing edges in the region of the slot 6 for reasons which will become more apparent below. The stiffeners 25, 26 may be fabricated from any suitable material, such as heavy, rigid, cardboard, and may be permanently fixed to the foldable sheet 1 by any convenient means such as with an adhesive.

Referring again to FIG. 3, a variant configuration is shown by which a reversible game board may be realized. While stiffener 25 overlays section half 3B', no stiffener is employed on section half 3A'. Instead, a second, smaller board game layout 27 is laid onto section half 3A' such that a secondary game may be played, finger pressure being exerted, in this instance, to deflect the lower contact pads 11 into engagement with the upper contact pads 10 instead of vice versa. In order to avoid the perception of different stiffnesses to the two halves of the primary board game layout 20, the stiffener 25 may, in this variant, be composed of two layers which are hinged together along the edge 28 adjacent the slot 6 such that the upper stiffener layer may be folded over the section half 3A' when the primary game is to be played.

The outer faces of the stiffener or stiffeners may have printed or otherwise impressed or placed thereon, game logos, game rules, advertising or such other written and/or graphic information that may be desired.

Figure 3:
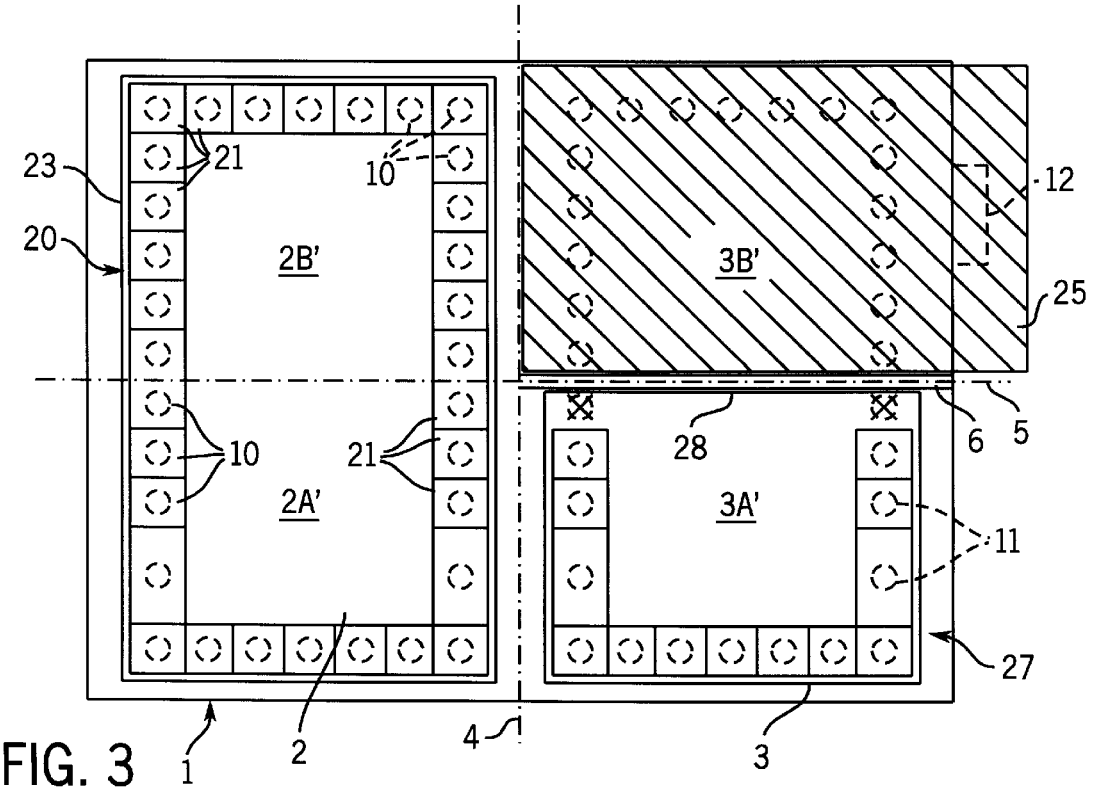
FIG. 3 is a view similar to FIG. 2 showing certain variants of the indicia and structure on the reverse side of the foldable sheet.
Figure 4:
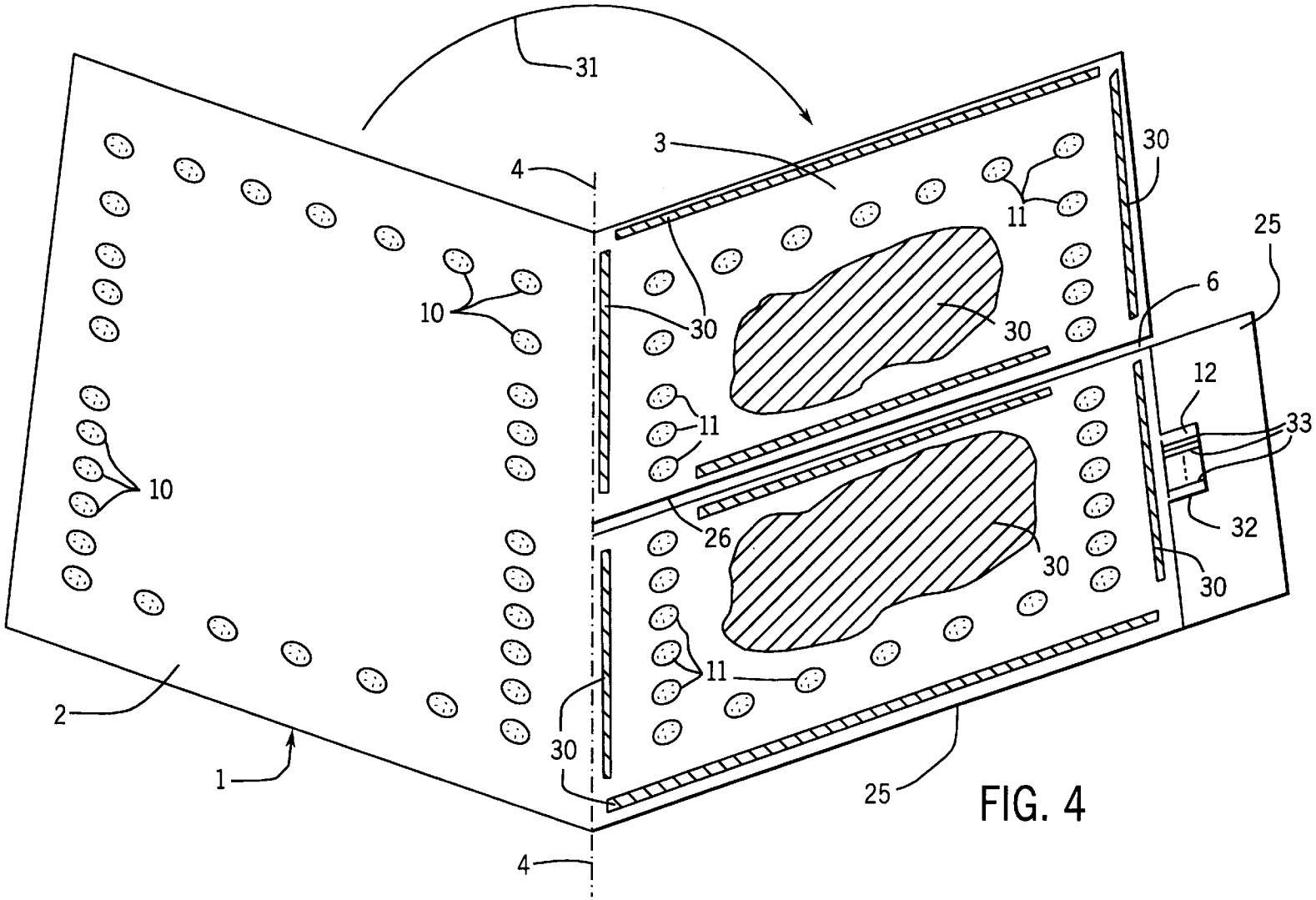
FIG. 4 is a perspective view illustrating a folding step carried out during the fabrication of a game board according to the present invention.

Consider now the step in the game board fabrication process illustrated in FIG. 4 in which the printed circuit is omitted for clarity except for a generalized depiction of the contact pads 10, 11 in order that FIG. 4 can readily be related to FIGS. 1, 2 and 3. It will thus be assumed that the complete printed circuit and resistive layers have been laid down on the obverse side of the foldable sheet 1 as previously described. Stiffeners 25, 26 are shown already fixed in place; however, it will be understood that the stiffeners may be secured to the reverse side of the foldable sheet 1 either before or after the folding and juxtaposing step shown in FIG. 4.

Adhesive 30 is applied along the edges of and in various appropriate position on the face of one or both of the obverse sides of the sections 2, 3. Then, a permanent fold, represented by arrowed arc 31, is made along the fold line 4 to bond the obverse sides of the sections 2, 3 together in face-to-face relationship in which the upper contact pads 10 are juxtaposed in registration with the lower contact pads 11 to effect an array of pressure sensitive switches as discussed above and to be further described below. In order to facilitate the folding step, the foldable sheet may first be pressure creased along the fold line 4 on at least one side. The resulting game board structure is illustrated in FIGS. 5, 6, 7, 8 and 9.

It will be observed in FIG. 4 that a portion of the stiffener 25 extends outwardly beyond the foldable sheet 1 in the direction of the connector 12. As previously mentioned, this feature facilitates the support of a control unit (not shown in FIG. 4) which electrically engages the conductive strips 33 on the upper surface of the connector 12 to establish electrical communication between the contact pads 10, 11 and the control unit. Preferably, a thin, resilient pad 32, such as sponge neoprene, is emplaced between the lower face of the connector 12 and the upper face of the stiffener 25 in order to provide a slight amount of spring bias between the conductive strips 33 and corresponding mating conductors present on the control unit. This insures a permanent good contact between the printed circuit and the control unit when the control unit has been fixed in place permanently during the is game board fabrication process.

Figure 6:
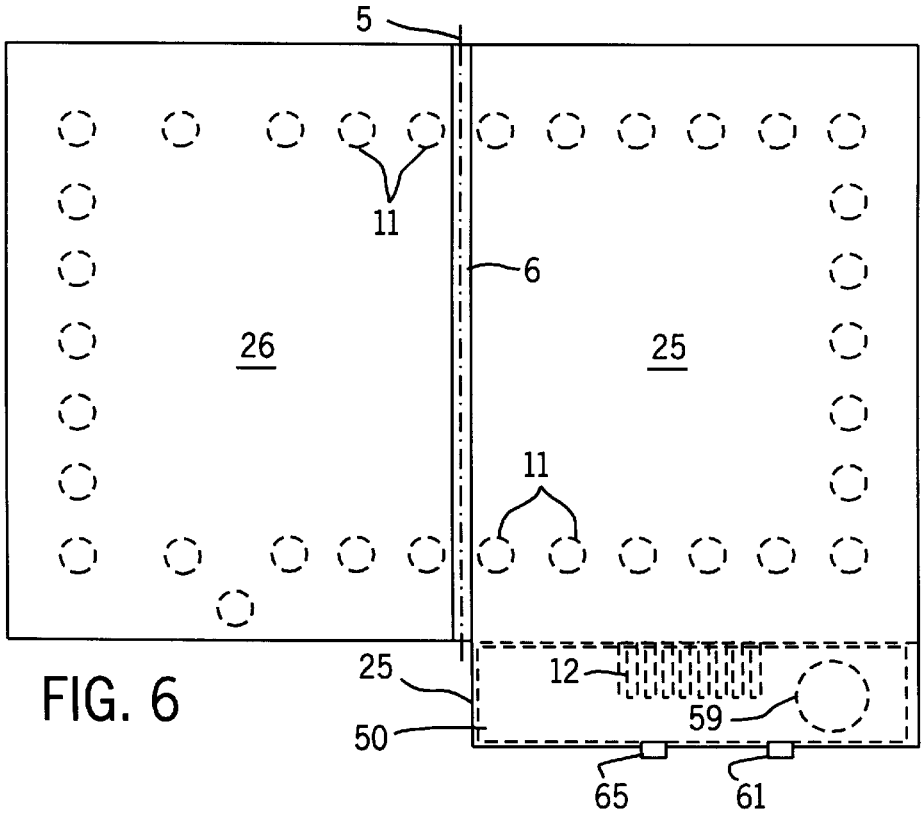
FIG. 6 is a bottom plan view of the competed game board.
Figure 7:
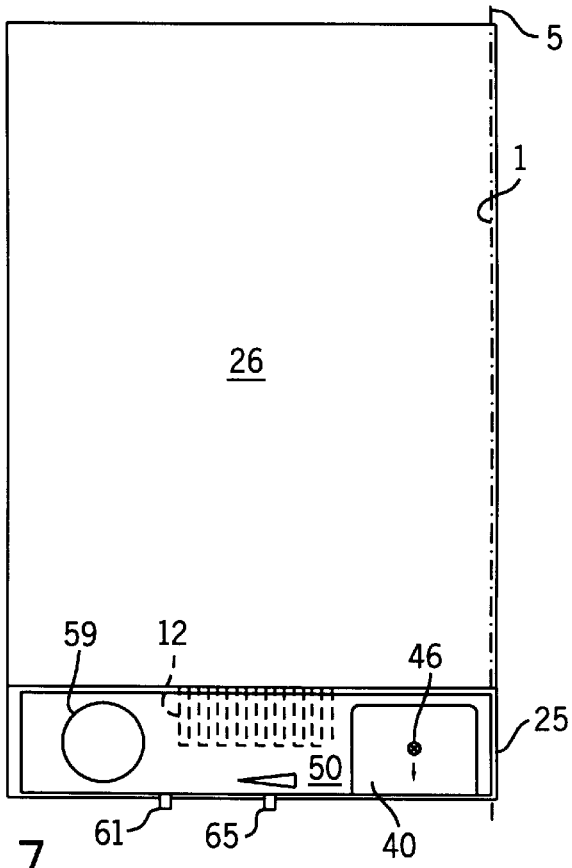
FIG. 7 is a view of the completed game board shown folded into a storage configuration.

The game board illustrated in FIGS. 5, 6 and 7 is the presently preferred variant shown in FIG. 2. Referring particularly to FIG. 5, a game board layout 20 is illustrated which, merely for reasons of example only, includes a rectangular path made up of a series of adjacent contiguous rectangular areas 21 serially provided generally about the periphery of the game board layout. In the example, all but a few of the rectangular areas 21 are each provided with indicia 41 relating a given rectangular area 21 to a named position in the game. Some positions are indicated by the name of an insect, others by the name of a bird, yet others by the name of a domestic animal and still others by the names of a wild animal. In the example, the corner rectangles have no such designations except for the lower left corner which is identified as the start/finish position. Thus, as will be evident, the game may be played according to specified rules such that tokens (not shown in FIG. 5) assigned to each player may progress around the game path in accordance with the game rules. For example, dice 45 may be alternately thrown by each player, and card stacks 44 may supplement the game according to the rules. It will be understood that the layout 20 illustrated in FIG. 5 and the corresponding game are fanciful and are intended to be broadly representative of the entire spectrum of board games.

A control unit 50 is shown permanently emplaced, typically through the use of an adhesive, upon the upper surface of the stiffener 25 such that contacts carried on the lower surface (out of view in FIG. 5) of the control unit engage the conductive strips of the connector 12. The control unit 50, the circuitry of which will be discussed in more detail below, includes an on/off switch 61, an optional volume control 65, a speaker 59 and a battery compartment 40. The top of the battery compartment may be opened by removing a screw 46 in order to facilitate changing the batteries from time to time while protecting against unauthorized access by a child.

Within each rectangular area 21, there is provided an indicia, such as an "X" 42, which serves to identify the position at which an upper contact pad 10 exists hidden immediately below as previously described. Thus, the indicia 42 inform the players of the points to press as the game progresses according to the rules. IN addition, a larger "X" 43 identifies the position of the (FIG. 1). The on/off switch 15, 16 is redundant with the on/off switch 61, and it is contemplated that one or the other would be provided for a given game, although the pressure sensitive on/off switch 43 can be employed to obtain a diverse function if desired.

It will be noted that the "ROADRUNNER" rectangular area shows the cross section reference to 8—8 across a switch position. FIG. 8, the corresponding cross sectional view, will be discussed in detail below.

FIG. 6 shows the back side of the game board illustrated in FIG. 5. The stiffeners 25, 26 serve not only to provide stiffness to the game board in use, but also effectively prevent the actuation of the lower contact pads 11 into engagement with the upper contact pads 10 in order to prevent accidental actuation. As previously mentioned, the outer surfaces of the stiffeners 25, 26 may carry game logos, rules, advertising or other appropriate graphics and text.

FIG. 7 shows the right side (FIG. 5) of the game board folded over the left side to obtain a storage configuration for the game board. Thus, the outside of the stiffener 26 is in view in FIG. 7, and the outside of the stiffener 25 is on the reverse side of the view shown in FIG. 7. When the fold is made, along imaginary fold line 5, to place the apparatus into the storage condition, the folded edge of the foldable sheet 1 will be protected because it is disposed slightly within the proximate edges of the stiffeners 25, 26 as best shown in FIG. 7. This result is achieved by appropriately selecting the thickness of the stiffeners 25, 26 and their precise placement on the foldable sheet 1 to achieve this result which enhances the long term durability of the game board. In addition, it is desirable, during the fabrication process, to pressure crease the foldable sheet 1 along the fold line 5 on at least one side to promote consistent folding and unfolding over the long term.

Attention is now directed to the pressure sensitive switch construction shown in FIGS. 8 and 9. First referring to FIG. 8, and also referring as necessary to FIGS. 1 and 5, the section 3 of the foldable sheet 1 is supported by stiffener 26. Overlaying the sheet section 3 is a lower contact pad 11 which is at least partially circumscribed by resistive layer 19. The section 2 of foldable sheet 1 carries an upper contact pad 10 registered in juxtaposition with the lower contact pad 11 as previously described in conjunction with the description of FIGS. 1 and 4. As will be apparent from an examination of FIG. 8, the thickness of the resistive layer 19 is such that the contact pads 10, 11 are maintained in a slightly spaced, normally-open switch condition.

In FIG. 9, the switch is shown momentarily actuated by pressure from a finger 48 pressing downwardly on the sheet section 2 in the area of the "X" shown in the "ROADRUNNER" rectangle of FIG. 5. As a result of the pressure applied by the finger 48, the sheet section 2 is locally deflected slightly downwardly to bring the upper contact pad 10 into conductive engagement contact with the lower contact pad 11, thus completing the circuit to effect a momentary switch closure. This condition can readily be sensed by a decoder, as will be described below, to identify the specific switch which has been closed in order that an appropriate audible response may be issued from the speaker 59 (FIG. 5).

When the finger pressure is released, the natural resilience of the sheet section 2 will cause the exemplary switch to spring back into the normally open condition illustrated in FIG. 8.

In FIGS. 8 and 9, it will be understood that the various vertical dimensions are somewhat exaggerated for best illustrating the operation of the exemplary switch. Actual exemplary thicknesses for the conductive pads 10, 11 and dielectric layer 19 will be discussed below.

Attention is now directed to FIG. 10 which is a block diagram of the electronic components of the control unit 50. Connector 51 is adapted to abut connector 12 in such a manner as to establish electrical communication between the printed circuit laid on the foldable sheet 1 (FIG. 1) and the control unit. Thus, the eight leads 52 connected to the eight groups of four lower contact pads 11 (FIG. 1), the four leads 53 connected to the four groups of eight tipper contact pads 10 and the two leads 54 connected to the switch pads 15, 16 are brought into the control unit.

The leads 54 are connected to on/off module 60 which may be a conventional unit responsive to alternate actuations of the on/off switch 15, 16 in the printed circuitry to correspondingly actuate and deactuate a switch 61. Switch 61 is connected in series between a battery 62 and the several circuit blocks within the control unit 50. Accordingly, successive actuations of the on/off printed circuit switch turns the control unit alternatively off and on in the well known manner. Alternatively, switch 61 may be manually actuable and incorporated into the control unit as previously described.

A decoder 55 conventionally matrix-decodes the information on the line sets 52, 53 to identify a given switch closure and to provide a five-bit binary address code, representative of that given switch, to a microprocessor 56. (Alternatively, thirty-two lines, each identifying a specific switch, may be coupled between the decoder 55 and the microprocessor 56. The specific configuration merely depends on the routine design choice of what logic family to employ.)

The microprocessor 56 includes a memory 57 in which a plurality, thirty-two in the example, of sequences of sounds are stored. Depending upon the identification of an actuated switch on the game board, a predetermined audio drive signal sequence is sent to sound generator 58 which drives speaker 59 to render the audio passage signal audible. The output volume of the sound issued by speaker 59 may be controlled by an optional volume control 65. Those skilled in the art will understand that the memory for the storage of the sound passages may alternatively be incorporated in the sound generator. At the state-of-the-art, all the components employed in the control unit are available off-the-shelf, and it is only necessary to support and interconnect them on a suitable control unit printed circuit (not shown). Further, it is possible, at the state-of-the-art of integrated circuit technology to combine all the electronic components into a single, special purpose chip if the economics are rationalized.

It may be noted that another block, output interface 62, is shown in FIG. 10. The purpose of this optional block, not otherwise treated in this specification, is to provide for the incorporation of visible, as well as audible, enhancements to the board game under the direction of the microprocessor 56. For example, various lights, typically light emitting diodes, may be systematically distributed across the board game layout and driven for this purpose via lines represented by bus 62 and the connectors to a suitably expanded printed circuit. The lights may be employed to echo an actuated switch or for other appropriate purposes related to the game depicted by the board game layout. For a complete exposition of the operation and use of the output interface 61, one may refer to copending U.S. patent application Ser. No. 07/980,649 for ELECTRONIC BOOK, filed Nov. 24, 1992, by Stephen I. McTaggart, now U.S. Pat. No. 5,484,292 incorporated herein by reference.

Thus, it will be understood that the response of the control unit 50 to a switch closure may be the issuance of a sensible (i.e., capable of being sensed by one of the senses: sight, sound, touch smell) signal, an audible passage in the example chosen for illustration, which is communicated to a user. Further, it is contemplated that the delivery point of a signal may be on the game board proper. For example, as disclosed in detail in the above-mentioned copending patent application in a different environment, the responsive signal may be the illumination of a light, such as a light emitting diode, strategically positioned on the game board.

Attention is now directed to FIGS. 11, 12, 13 and 14 which illustrate a variant, generic embodiment of the invention. Referring particularly to FIG. 11, the obverse side of a foldable sheet 1 having first section 2 and second section 3 is shown. As previously described in conjunction with FIG. 1, imaginary fold lines 4, 5 are oriented as shown, and the sheet section 3 is bifurcated by a slot 6. However, the printed circuit layout of the FIG. 11 embodiment is generalized for use with any number of games whereas the printed circuit layout of FIG. 1 is specifically oriented and configured to accommodate the game illustrated in FIG. 5.

Thus, in FIG. 11, it will be appreciated that the upper contact pads 10 are disposed in two four-by-seven matrices generally indicated at 70, 71. Similarly, the lower contact pads 11 laid down on the sheet section 3 are similarly arranged in two four-by-seven matrices 72, 73. The lower contact pads 11 in each horizontal group of seven are connected together and to one conductive lead which terminates at connector 12. The upper contact pads 10 are grouped into two vertically aligned groups of four, respectively, in the arrays 70, 71 and are connected together and to a conductor which terminates at the connector 12 as shown in FIG. 11. Therefore, it will be understood that the resulting electrical matrix is connected as a seven by eight array which can readily be decoded to identify individual switch closures employing an off the shelf eight by eight decoder 55 (FIG. 10).

A resistive pattern, preferably a dielectric ink as before, is also laid down on the sheet sections 2, 3, as indicated at 84, 89 to insure against shorting when the sections are folded together during the fabrication process. It will be observed that, in some instances, the resistive pattern overlays the conductive traces. Once the folded sheet has been permanently folded along the fold line 4 during the fabrication process, in the manner equivalent to that shown in FIG. 4, the upper contact pads 10 will be brought into registration with the lower contact pads 11 to establish a contact switch pair. In addition, it will be particularly noted that each upper contact pad 10 and each lower contact pad 12 is surrounded by a generally rectangular resistive pattern 89 which, as noted above, overlays conductive leads 83 in some places. This feature will be discussed more fully below in conjunction with the discussion of FIG. 14.

The game board structure illustrated in FIG. 11 is folded along imaginary fold line 4, in the same manner as illustrated in FIG. 4, to obtain the game boards shown in FIGS. 12 and 13 in which the stiffeners 25, 26 and control unit 50 have also been incorporated in the manner previously discussed.

The potential advantage of this structure in which the switch pads are laid out in two or more regular, rectangular grids (two grids on each sheet section in the example) are readily evident from a study of FIGS. 12 and 13. In FIG. 12, a board game similar to that illustrated in FIG. 5 employs a board game layout 74 (similar to the board game layout 20) which has been imprinted or otherwise provided on the upper surface of the section half 2 of the foldable sheet 1, all substantially as previously described. Thus, the game layout 74 contemplates a more or less rectangular path for moving players' tokens generally about the periphery of the game layout. Therefore, the switch elements 75 falling within this path are rendered active; and actuation, as may be appropriate, of the individual switches is invited by an "X" disposed in each rectangular segment along the token path. With respect to the remaining switch elements 76 which are encompassed by the switch elements 75 along the token path, all, some, or none may be relevant to the game represented by the layout 74. Thus, merely by way of example, only switch elements 76A may be appropriate for actuation in the game represented by the game layout 74, and thus, only those switch element positions are marked by an "X".

Referring briefly also to FIG. 10, the decoder 55 (FIG. 10) may, itself, be conventionally encoded to recognize only the switch element positions marked for actuation in FIG. 12. Alternatively, the decoder 55 may be configured to pass the decoded address of each actuated switch, whether active or inactive with respect to a given game layout, to the microprocessor 56 which, itself, determines, from information stored in memory 57, which switches are to be recognized as active for a given game and which response is to be made to the actuation of each such active switch.

Consider now the game board layout 77 shown in FIG. 13 in which an apparently random path along the course of a game is shown by successive arrowed lines progressing from a start position to a finish position. Thus, switch elements 78 are relevant to the game while some or all the remaining switch elements 79 are not. For example, switch elements 79A, which fall outside the game path, may also be relevant to the game and therefore may be activated as well as the switch element 78. Again, the switch elements 78, 79 to be recognized in accordance with the game layout 77 may be encoded into the decoder 55 or into the microprocessor 56.

The cross sectional view shown in FIG. 14 is similar to that shown in FIG. 8, but reflects the regular, rectangular grid layout for both the contact pads 10, 11 and the resistive deposits 89 in the regions surrounding the contact pads. Further, in some instances, the resistive deposits 89 overlay the printed circuit traces 83, and this is the case for the switch structure shown in FIG. 14. Thus, the contact pads 10, 11 are juxtaposed in a spaced-apart, normally-open state by the surrounding two layers 89 of resistive material, the lower one of which also overlays conductive traces 83. A subtle advantage of this configuration, in which resistive deposits are made on both sheet section 2, 3 before the folding fabrication step, is that the resistive layers do not have to be as thick as in the corresponding functional layers 19 as shown in FIG. 8. This, in turn, facilitates the deposition process itself.

FIG. 15 shows another layout technique for the printed circuit structure of the game board. In this configuration, it will be observed that all the printed circuit traces to the connector 12 lead to conductive pads effecting contact pairs 90 disposed on the first section 2 of the obverse side of the foldable sheet 1. Each contact pair 90 includes a first contact pad 90A and a second, adjacent, proximally spaced contact pad 90B. The contact pads 90A and 90 B each have conductive fingers which interleave, but do not touch, thereby establishing a normally-open contact pair. On the second section 3 of the foldable sheet 1, there are laid down shorting contacts 91 in a pattern whereby, when the foldable sheet 1 is folded along the fold line 4 during the fabrication process, in a manner equivalent to that shown in FIG. 4, each of the contact pairs 90 registers with one of the shorting contacts 91 to make up a switch pair.

In a manner comparable to that shown and discussed with respect to the embodiment shown in FIG. 11, each contact pair 90 and each shorting contact 91 is surrounded by a generally rectangular resistive pattern 92. It will therefore be understood that the resulting normally-open switch pair will operate substantially as previously discussed with respect to FIGS. 8, 9 and 14 except that the deflection of a contact pair 90 into its corresponding shorting contact 91 serves to close the circuit between the contact pair 90. This condition is communicated to the decoder 55 (FIG. 10) via the connector 12 as a closure between the relevant traces.

As previously indicated with respect to the switch configuration s FIG. 8, the resistive pattern 92 can be applied only around one or the other of the contact pairs 90 or the shorting contacts 91 if it is of sufficient thickness to reliably establish the normally-open state of the switch pairs. Preferably, however, the use of abutting resistive patterns around each of the contact pairs 90 and shorting contacts 91, as shown in FIG. 15, serves to allow the use of thinner and more easily controlled dielectric layers.

There are many different printed circuit layouts which can be employed to practice the invention according to the variant shown in FIG. 15, and the one shown is only for purposes of illustration. The governing principle is that all the contact pads which are to be coupled to the connector 12 are resident on one section of the foldable sheet 1. In the example, the contact pairs are connected in columns of eight and rows of seven, with each column and row being connected to the connector 12 such that the decoder 55 (FIG. 10) can determine if a switch pair is closed and which switch pair in the manner previously described.

The circuit layout approach shown in FIG. 15 may, in some instances, offer an advantage during both the fabrication process and in use. However, there is also an inherent characteristic of the configuration shown in FIG. 11, and its equivalents, which should be taken into account during the circuit pattern selection operation. Somewhat more complexity of the circuit pattern on the section chosen to receive it is inevitable, and there is also a necessity to employ a certain amount of multi-layer printed circuit technology in certain areas of the layout. For example, in FIG. 15, it will be apparent to those skilled in the art that the area 93, shaded to indicate the presence of deposits of dielectric ink, must be prepared using multi-layer printed circuit technology, all as well known in the art. Area 94 is a dielectric layer overlaying the circuit traces in that region on the second section 3, but only for the purpose of providing insulation between the traces below and those on the first section 2 as previously described.

While the materials and techniques which may be employed in practicing the invention are widely diverse, certain particulars of these materials and techniques as presently preferred will be found useful in readily fully understanding the invention.

It has been noted above that a game board layout may alternatively be printed directly on the foldable sheet 1 or the game area may be overlaid with a separate thin sheet on which the game layout has been printed. Where a unitary construction in which the game layout (e.g., 20 in FIG. 2) is employed, printing of the visual material on the reverse side and the printed circuit on the obverse side can be effected concurrently or sequentially on the sheet 1, prior to the folding step shown in FIG. 4, using conventional printing equipment. Any printing equipment that is capable of effecting selective solid coverage ink transfer distribution can be utilized.

Suitable printing equipment include Gravere and Flex-O-Press printing presses and screen printing apparatus. Standard multi-station offset printing presses can also be utilized, if properly configured to deposit the printed circuit in "solid coverage"; i.e., so that the conductive ink deposited by the press printing units does not include any interstices. That is to say, in such a manner that the dots of conductive ink deposited by the press overlap or overlay to provide a continuous conductive path.

Specifically, web-fed offset printing presses typically include a number of successive print stations. Each print station is associated with a particular color, and, typically, includes tipper and lower sets of rollers to selectively apply ink of that color to both sides of the web (i.e., foldable sheet 1) on a substantially concurrent basis. The web passes through the respective printing stations in sequence to develop a multi-color image. Each printing station applies its respective ink in accordance with an associated dot matrix (corresponding to a color separation) established by a plate. The operation of the individual units is coordinated so that the respective images as printed are in registry. The combinations of colors and relative dispositions of the matrices provide a composite image having the desired form, composition, and color.

Thus, for example, the game board layout 20 on the one hand and the printed circuit on the other hand can be concurrently printed employing one set (e.g., the upper) of print rollers in the respective stations to lay down the game board layout and the other set (e.g., the lower) of print rollers in the stations to deposit the printed circuit. Disposition of a continuous conductive path along each trace of the printed circuit can be facilitated by employing a plurality of successive print stations, each applying the conductive ink in sequence. The respective dot matrices laid down by the successive units are preferably slightly offset, but overlap each other. The dots of ink, in effect, bleed together, to ensure a continuous conductive path. This result can be facilitated by laying the conductive ink down more thickly than is typical for non conductive ink in a typical color process.

As discussed in conjunction with both FIGS. 1 and 11, it is desirable to provide insulation between portions of the circuitry brought into adjacency by the folding step shown in FIG. 4. While this could be achieved by the insertion of an insulating sheet, it is more efficient to obtain the same effect by selectively overprinting the surface or surfaces carrying the conductive ink with non conductive or dielectric ink. For example, the printed circuit can be selectively coated with a layer of flexible dielectric ink such as the product marketed by Olin Hunt Specialty Products Inc., a subsidiary of the Olin Corporation of Ontario, Calif., under the name "37AC22 Curable Spacer" or equivalent insulating material. As has previously been explained, this process can be employed to make the pressure sensitive switches in a particularly economical fashion.

Referring again to FIGS. 8 and 9, dielectric ink 19 is interposed between sheet sections 2,3, preferably printed in a predetermined pattern on one or both of the facing surfaces in predetermined positions; e.g., adjacent, circumscribing or even overlying, conductive pads 10, 11. The pressure necessary to actuate the switch can be closely controlled by correspondingly controlling the thicknesses of the conductive layers, 10, 11, the thickness(es) of the insulating layer(s) 19 and the distance between the center of the pads 10, 11 to the surrounding insulating layer(s), all with respect to the inherent resilience of the foldable sheet 1. In one embodiment, actuation at approximately seven ounces per square inch of pressure is preferred. The fact that the pads 10, 11 are more or less circumscribed by the annulus character of the dielectric layer(s) 19 serves to beneficially increase the localization of the force such that proximate switches are not inadvertently actuated; i.e., a given switch will only be actuated in response to pressure from directly above the contact pads.

The foldable sheet 1 is preferably made of non conductive material capable of accepting flexible conductive ink. Any material which will accept the inks employed, such as a heavy paper or suitably coated or otherwise prepared plastic and which can be folded without breakage, is acceptable. Typically, the fold lines 4, 5 are provided through what is referred to in the art of book-making as "living-hinge" technology, which involves the formation of a hinge line by scoring it or compressing it onto the material constituting the leaf of a book. The material used may vary from pure paper to pure synthetic substances, including a variety of composite materials. For example, the products sold by Paper Sources International under the trademark "Chromolux" and by the Champion International Corporation under the trademark "Cromekote" consist of paper coated on both sides with a layer of synthetic material, available in overall thicknesses from approximately 6 to 18 thousands of an inch. The product marketed by the Kimberly-Clark Corporation under the trademark "Kimdura" consists entirely of synthetic paper, a polypropylene material, available in thicknesses ranging from about 3 to 12 thousands of an inch. The materials marketed by the Spring Hill Paper Company under the trademark "Claycoat" and by the ICI Company of England under the trademark "Melinex" consist of a polyester substrate. These materials are all suitable to practice the invention and can all be folded for long-term durability in the manner described above. Thus, the term "paper" as used herein comprehends such materials as well as classical papers.

The foldable sheet 1 may be die cut although such is not essential. To some extent, the selection of the process to cut and trim the foldable sheet depends upon the material chosen and its thickness and also on whether the printed matter is deposited directly or on a separate sheet which is subsequently fixed to the foldable sheet.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A game board incorporating means for selectively providing sensory game enhancement comprising:

A) a foldable sheet having first and second sides, each said side of said foldable sheet being divided into first and second sections;

B) said first and second sections of said first side of said foldable sheet having overlaid thereon a conductive printed circuit including a plurality of switch contact pads;

C) said switch contact pads overlaid on said first section of said first side of said foldable sheet comprising a plurality of upper contacts;

D) said switch contact pads overlaid on said second section of said first side of said foldable sheet comprising a plurality of lower contacts;

E) said upper and lower contacts being positioned, respectively, on said first and second sections of said first side of said foldable sheet such that, when said foldable sheet is folded along a predetermined line to bring said first and second sections of said first side of said foldable sheet into face-to-face relationship, each of said upper contacts registers with one of said lower contacts to effect a switch pair;

F) spacer means adapted to juxtapose said upper and lower contacts of each said switch pair in a normally spaced-apart relationship to define a normally-open condition such that finger pressure applied to said second side of said foldable sheet above a given upper contact and on the opposite side thereof urges said given upper contact into conductive contact with the said lower contact with which it registers, thereby effecting a momentary closure of the switch pair;

G) said printed circuit further including traces coupling all said upper contacts and all said lower contacts to decoder means, said decoder means being adapted to sense if a switch pair is closed and, if so, which switch pair;

H) at least one section of said second side of said foldable sheet having emplaced thereon a game board layout; and I) signal producing means coupled to said decoder means, said signal producing means being adapted to issue a predetermined sensible sequence in response to the detection by said decoder means that a specific contact pair has been momentarily closed.

2. The game board of claim 1 in which said game board layout includes indicia identifying the position of each underlying switch pair to be used in the performance of a game which can be played in accordance with said game board layout.

3. The game board of claim 1 in which:

A) a first section of said second side of said foldable sheet has emplaced thereon a first game board layout which includes indicia identifying the position of each underlying switch pair to be used in the performance of a game which can be played in accordance with said first game board layout; and B) a second section of said second side of said foldable sheet has emplaced thereon a second game board layout which includes indicia identifying the position of each underlying switch pair to be used in the performance of a game which can be played in accordance with said second game board layout;

such that a reversible game board is effected.

4. The game board of claim 3 in which said second section is bifurcated by a slot extending from the center of an edge of said second section to the center of said foldable sheet, thereby defining section halves, said slot being of sufficient width to facilitate a temporary fold along a centerline of said game board layout to render said game board more compact for storage, said edge of said second section being disposed parallel to the axis of said temporary fold.

5. The game board of claim 4 which further includes at least one stiffening substrate fixed to the one of said section halves which has no game board layout emplaced thereon.

6. The game board of claim 3 in which said first and second game board layouts are emplaced by overlaying said first and second sections of said second side of said foldable sheet with respective first and second pre-printed game board layouts.

7. The game board of claim 3 in which said game board layout is emplaced by direct printing on said one section of said second side of said foldable sheet.

8. The game board of claim 1 in which said second section is bifurcated by a slot extending from the center of an edge thereof to the center of said foldable sheet, thereby defining section halves, said slot being of sufficient width to facilitate a temporary fold along a centerline of said game board layout to render said game board more compact for storage, said edge of said second section being disposed parallel to the axis of said temporary fold.

9. The game board of claim 8 which further includes first and second stiffening substrates fixed, respectively, to said section halves.

10. The game board of claim 9 in which said decoder means and said signal producing means are incorporated into a control unit coupled to said printed circuit and in which said control unit is supported on an extension of one of said stiffening substrates.

11. The game board of claim 8 in which said game board layout is emplaced by overlaying said one section of said second side of said foldable sheet with a pre-printed game board layout.

12. The game board of claim 8 in which said foldable sheet is a sheet of paper.

13. The game board of claim 8 in which said foldable sheet is die cut.

14. The game board of claim 8 in which a plurality of said traces from said contact pads terminates at a first connector and inputs to said decoder means are coupled to a second connector, said first and second connectors being electrically engaged to couple said plurality of traces to said decoder means.

15. The game board of claim 8 in which said first and second sections of said first side of foldable sheet are joined with an adhesive.

16. The game board of claim 8 in which said signal producing means comprises:

A) a sound generator adapted to issue a predetermined audio drive signal sequence when said decoder detects that a given switch pair has been momentarily closed; and B) an audio transducer connected to and driven by said sound generator for audibly reproducing said signal sequence.

17. The game board of claim 1 in which said conductive printed circuit comprises conductive ink.

18. The game board of claim 17 in which said spacer means comprises a deposit of dielectric material disposed proximate said upper and lower contacts of each switch pair, said deposit being of sufficient thickness to juxtapose a switch pair in said normally-open condition, said deposit being shaped so as to permit effecting a closure by finger pressure applied to said second side of said foldable sheet above a given switch pair, thereby flexing said upper contact of said given switch pair into a closure with said lower contact of said given switch pair in a region in which said deposit is not present.

19. The game board of claim 18 in which said dielectric material comprises dielectric ink.

20. The game board of claim 18 in which said game board layout is emplaced by direct printing on said one section of said second side of said foldable sheet.

21. The game board of claim 18 in which said game board layout is emplaced by overlaying said one section of said second side of said foldable sheet with a pre-printed game board layout.

22. The game board of claim 18 in which said foldable sheet is a sheet of paper.

23. The game board of claim 18 in which said foldable sheet is die cut.

24. The game board of claim 18 in which a plurality of said traces from said contact pads terminates at a first connector and inputs to said decoder means are coupled to a second connector, said first and second connectors being electrically engaged to couple said plurality of traces to said decoder means.

25. The game board of claim 18 in which said first and second sections of said first side of foldable sheet are joined with an adhesive.

26. The game of claim 18 in which said signal producing means comprises:

A) a sound generator adapted to issue a predetermined audio drive signal sequence when said decoder detects that a given switch pair has been momentarily closed; and B) an audio transducer connected to and driven by said sound generator for audibly reproducing said signal sequence.

27. The game board of claim 1 in which said game board layout is emplaced by direct printing on said one section of said second side of said foldable sheet.

28. The game board of claim 1 in which said game board layout is emplaced by overlaying said one section of said second side of said foldable sheet with a pre-printed game board layout.

29. The game board of claim 1 in which said game board layout is emplaced by direct printing on said at least one section of said second side of said foldable sheet.

30. The game board of claim 1 in which said foldable sheet is a sheet of paper.

31. The game board of claim 1 in which said foldable sheet is die cut.

32. The game board of claim 1 in which a plurality of said traces from said contact pads terminate at a first connector and inputs to said decoder means are coupled to a second connector, said first and second connectors being electrically engaged to couple said plurality of traces to said decoder means.

33. The game board of claim 32 in which said decoder means and said signal producing means are incorporated into a control unit which includes said second connector.

34. The game board of claim 1 in which said first and second sections of said first side of foldable sheet are joined with an adhesive.

35. The game board of claim 1 in which said signal producing means comprises:

A) a sound generator adapted to issue a predetermined audio drive signal sequence when said decoder detects that a given switch pair has been momentarily closed; and B) an audio transducer connected to and driven by said sound generator for audibly reproducing said signal sequence.

36. The game board of claim 1 in which said decoder means and said signal producing means are incorporated into a control unit electrically coupled to said printed circuit.

37. The game board of claim 1 in which said signal producing means comprises:

A) a sound generator adapted to issue a predetermined audio drive signal sequence when said decoder detects that a given switch pair has been momentarily closed; and B) an audio transducer connected to and driven by said sound generator for audibly reproducing said signal sequence.

38. The game board of claim 1 in which said decoder means and said signal producing means are incorporated into a control unit electrically coupled to said printed circuit.

39. The game board of claim 1 in which said foldable sheet is pressure creased along said predetermined line to facilitate folding therealong.

40. The game board of claim 1 which further includes:

A) at least two of said switch contact pads overlaid on one of said sections of said first side of said foldable sheet being arranged in a contact pair of adjacent switch contact pads disposed in proximally spaced-apart relationship;

B) at least one said switch contact pad overlaid on the other said section of said first side of said foldable sheet comprising a shorting contact;

C) said contact pair and said shorting contact being positioned on said first and second sections of said first side of said foldable sheet such that, when said foldable sheet is folded along said predetermined line to bring said first and second sections of said first side of said foldable sheet into face-to-face relationship, said contact pair registers with said shorting contacts to effect an alternative switch pair; and D) spacer means adapted to juxtapose said contact pair and said shorting contact in a normally spaced-apart relationship to define a normally-open condition such that finger pressure applied to said second side of said foldable sheet above said alternative switch pair urges said contact pair into conductive contact with the said shorting contact, thereby effecting a momentary closure of said alternative switch pair.

41. A method for making a game board incorporating means for selectively providing sensory game enhancement the comprising the steps of:

A) establishing first and second sides of a foldable sheet;

B) establishing first and second sections on each of the first and second sides of the foldable sheet;

C) laying a conductive printed circuit on the first and second sections of the first side of the foldable sheet, the printed circuit including at least one contact pad on each of the first and second sections, the contact pads being configured and disposed to effect a switch pair when the foldable sheet is folded according to step E);

D) laying spacer means at least partially encompassing each contact pad laid on at least one of the first and second sections;

E) folding the sheet along a predetermined line to bring the first and second sections of the first side of the foldable sheet into face-to-face relationship such that the contact pad on the first section is brought into over-and-under registration with the contact pad on the second section and juxtaposed spaced-apart therewith by the spacer means to establish a switch pair in a normally-open condition, which switch pair may be actuated into a momentarily-closed condition by finger pressure applied to the second side of the foldable sheet at a designated position;

F) emplacing a board game layout on the second side of the foldable sheet, which layout includes indicia indicating the designated position for selectively actuating the switch pair;

G) coupling the switch pair to a circuit adapted to sense a closure thereof; and H) coupling to the circuit a signal producing means which is responsive to a momentary closure of the switch pair to issue a predetermined sensible sequence.

42. The method for making a game board as set forth in claim 41 in which:

A) a plurality of contact pads are laid on each of the first and second sections such that a corresponding plurality of switch pairs are obtained;

B) each switch pair is coupled to the circuit which includes a decoder adapted to sense and identify a switch closure; and C) the signal producing means is further adapted to issue one of a plurality of predetermined sensible sequences according to which switch pair is actuated.

43. The method for making a game board as set forth in claim 42 which further includes the step of fixing a stiffener to at least one section on the second side of the foldable sheet.

44. The method for making a game board as set forth in claim 41 in which the conductive printed circuit is laid down by printing with conductive ink.

45. A game board incorporating means for selectively providing sensory game enhancement comprising:

A) a foldable sheet having first and second sides, each said side of said foldable sheet being divided into first and second sections;

B) said first and second sections of said first side of said foldable sheet having overlaid thereon a conductive printed circuit including a plurality of switch contact pads arranged in at least one rectangular array on each of said sections;

C) said switch contact pads overlaid on said first section of said first side of said foldable sheet comprising a plurality of upper contacts;

D) said switch contact pads overlaid on said second section of said first side of said foldable sheet comprising a plurality of lower contacts;

E) said upper and lower contacts being positioned, respectively, on said first and second sections of said first side of said foldable sheet such that, when said foldable sheet is folded along a predetermined line to bring said first and second sections of said first side of said foldable sheet into face-to-face relationship, each of said upper contacts registers with one of said lower contacts to effect a switch pair;

F) spacer means adapted to juxtapose said upper and lower contacts of each said switch pair in a normally spaced-apart relationship to define a normally-open condition such that finger pressure applied to said second side of said foldable sheet above a given upper contact and on the opposite side thereof urges said given upper contact into conductive contact with the said lower contact with which it registers, thereby effecting a momentary closure of the switch pair;

G) said printed circuit further including traces coupling all said upper contacts and all said lower contacts to decoder means, said decoder means being adapted to sense if a switch pair is closed and, if so, which switch pair;

H) at least one section of said second side of said foldable sheet having emplaced thereon a game board layout; and I) signal producing means coupled to said decoder means, said signal producing means being adapted to issue a predetermined sensible sequence in response to the detection by said decoder means that a specific switch pair has been momentarily closed.

46. The game board of claim 45 in which said game board layout includes indicia identifying the position of each underlying switch pair to be used in the performance of a game which can be played in accordance with said game board layout.

47. The game board of claim 45 in which:

A) a first section of said second side of said foldable sheet has emplaced thereon a first game board layout which includes indicia identifying the position of each underlying switch pair to be used in the performance of a game which can be played in accordance with said first game board layout, and B) a second section of said second side of said foldable sheet has emplaced thereon a second game board layout which includes indicia identifying the position of each underlying switch pair to be used in the performance of a game which can be played in accordance with said second game board layout;

such that a reversible game board is effected.

48. The game board of claim 47 in which said second section is bifurcated by a slot extending from the center of an edge of said second section to the center of said foldable sheet, thereby defining section halves, said slot being of sufficient width to facilitate a temporary fold along a centerline of said game board layout to render said game board more compact for storage, said edge of said second section being disposed parallel to the axis of said temporary fold.

49. The game board of claim 48 which further includes at least one stiffening substrate fixed to the one of said section halves which has no game board layout emplaced thereon.

50. The game board of claim 47 in which said game board layout is emplaced by direct printing on said one section of said second side of said foldable sheet.

51. The game board of claim 47 in which said first and second game board layouts are emplaced by overlaying said first and second sections of said second side of said foldable sheet with respective first and second pre-printed game board layouts.

52. The game board of claim 45 in which said second section is bifurcated by a slot extending from the center of an edge thereof to the center of said foldable sheet, thereby defining section halves, said slot being of sufficient width to facilitate a temporary fold along a centerline of said game board layout to render said game board more compact for storage, said edge of said second section being disposed parallel to the axis of said temporary fold.

53. The game board of claim 52 which further includes first and second stiffening substrates fixed, respectively, to said section halves.

54. The game board of claim 53 in which said decoder means and said signal producing means are incorporated into a control unit detachably coupled to said printed circuit and in which said control unit is supported on an extension of one of said stiffening substrates.

55. The game board of claim 54 in which said game board layout is emplaced by direct printing on said one section of said second side of said foldable sheet.

56. The game board of claim 54 in which said game board layout is emplaced by overlaying said one section of said second side of said foldable sheet with a pre-printed game board layout.

57. The game board of claim 54 in which said game board layout is emplaced by direct printing on said at least one section of said second side of said foldable sheet.

58. The game board of claim 54 in which said foldable sheet is a sheet of paper.

59. The game board of claim 54 in which said foldable sheet is die cut.

60. The game board of claim 54 in which a plurality of said traces from said contact pairs terminate at a first connector and inputs to said decoder means are coupled to a second connector, said first and second connectors being electrically engaged to couple said plurality of traces to said decoder means.

61. The game board of claim 60 in which said decoder means and said signal producing means are incorporated into a control unit which includes said second connector.

62. The game board of claim 54 in which said first and second sections of said first side of said foldable sheet are joined with an adhesive.

63. The game board of claim 54 in which said foldable sheet is pressure creased along said predetermined line to facilitate folding therealong.

64. The game board of claim 52 in which said game board layout is emplaced by overlaying said one section of said second side of said foldable sheet with a pre-printed game board layout.

65. The game board of claim 45 in which said foldable sheet is a sheet of paper.

66. The game board of claim 52 in which said foldable sheet is a sheet of paper.

67. The game board of claim 52 in which said foldable sheet is die cut.

68. The game board of claim 52 in which said first and second sections of said first side of said foldable sheet are joined with an adhesive.

69. The game board of claim 52 in which said signal producing means comprises:

A) a sound generator adapted to issue a predetermined audio drive signal sequence when said decoder detects that a given switch pair has been momentarily closed; and B) an audio transducer connected to and driven by said sound generator for audibly reproducing said signal sequence.

70. The game board of claim 45 in which said foldable sheet is pressure creased along said predetermined line to facilitate folding therealong.

71. The game board of claim 45 in which said conductive printed circuit comprises conductive ink.

72. The game board of claim 71 in which said spacer means comprises a deposit of dielectric material disposed proximate said upper and lower contacts of each switch pair, said deposit being of sufficient thickness to juxtapose a switch pair in said normally-open condition, said deposit being shaped so as to permit effecting a closure by finger pressure applied to said second side of said foldable sheet above a given switch pair, thereby flexing said upper contact of said given switch pair into a closure with said lower contact of said given switch pair in a region in which said deposit is not present.

73. The game board of claim 72 in which said dielectric material comprises dielectric ink.

74. The game board of claim 72 in which said game board layout is emplaced by direct printing on said one section of said second side of said foldable sheet.

75. The game board of claim 72 in which said game board layout is emplaced by overlaying said one section of said second side of said foldable sheet with a pre-printed game board layout.

76. The game board of claim 72 in which said foldable sheet is a sheet of paper.

77. The game board of claim 72 in which said foldable sheet is die cut.

78. The game board of claim 77 in which a plurality of said traces from said contact pads terminate at a first connector and inputs to said decoder means are coupled to a second connector, said first and second connectors being electrically engaged to couple said plurality of traces to said decoder means.

79. The game board of claim 72 in which a plurality of said traces from said contact pads terminate at a first connector and inputs to said decoder means are coupled to a second connector, said first and second connectors being electrically engaged to couple said plurality of traces to said decoder means.

80. The game board of claim 72 in which said first and second sections of said first side of said foldable sheet are joined with an adhesive.

81. The game board of claim 72 in which said signal producing means comprises:

A) a sound generator adapted to issue a predetermined audio drive signal sequence when said decoder detects that a given switch pair has been momentarily closed; and B) an audio transducer connected to and driven by said sound generator for audibly reproducing said signal sequence.

82. The game board of claim 45 in which said game board layout is emplaced by direct printing on said one section of said second side of said foldable sheet.

83. The game board of claim 45 in which said game board layout is emplaced by overlaying said one section of said second side of said foldable sheet with a pre-printed game board layout.

84. The game board of claim 45 in which said game board layout is emplaced by direct printing on said at least one section of said second side of said foldable sheet.

85. The game board of claim 45 in which said foldable sheet is die cut.

86. The game board of claim 45 in which a plurality of said traces from said contact pads terminate at a first connector and inputs to said decoder means are coupled to a second connector, said first and second connectors being electrically engaged to couple said plurality of traces to said decoder means.

87. The game board of claim 86 in which said decoder means and said signal producing means are incorporated into a control unit which includes said second connector.

88. The game board of claim 45 in which said first and second sections of said first side of said foldable sheet are joined with an adhesive.

89. The game board of claim 45 in which said signal producing means comprises:

A) a sound generator adapted to issue a predetermined audio drive signal sequence when said decoder detects that a given switch pair has been momentarily closed; and B) an audio transducer connected to and driven by said sound generator for audibly reproducing said signal sequence.

90. The game board of claim 45 in which said decoder means and said signal producing means are incorporated into a control unit electrically coupled to said printed circuit.

91. The game board of claim 45 which further includes:

A) at least two of said switch contact pads overlaid on one of said sections of said first side of said foldable sheet being arranged in a contact pair of adjacent switch contact pads disposed in proximally spaced-apart relationship;

B) at least one said switch contact pad overlaid on the other said section of said first side of said foldable sheet comprising a shorting contact;

C) said contact pair and said shorting contact being positioned on said first and second sections of said first side of said foldable sheet such that, when said foldable sheet is folded along said predetermined line to bring said first and second sections of said first side of said foldable sheet into face-to-face relationship, said contact pair registers with said shorting contacts to effect an alternative switch pair; and D) spacer means adapted to juxtapose said contact pair and said shorting contact in a normally spaced-apart relationship to define a normally-open condition such that finger pressure applied to said second side of said foldable sheet above said alternative switch pair urges said contact pair into conductive contact with the said shorting contact, thereby effecting a momentary closure of said alternative switch pair.

92. A game board incorporating means for selectively providing sensory game enhancement comprising:

A) a foldable sheet having first and second sides, each said side of said foldable sheet being divided into first and second sections;

B) said first and second sections of said first side of said foldable sheet having overlaid thereon a conductive printed circuit including a plurality of switch contact pads;

C) said switch contact pads overlaid on said first section of said first side of said foldable sheet being arranged in contact pairs of adjacent switch contact pads disposed in proximally spaced-apart relationship;

D) said switch contact pads overlaid on said second section of said first side of said foldable sheet comprising a plurality of shorting contacts;

E) said contact pairs and said shorting contacts being positioned, respectively, on said first and second sections of said first side of said foldable sheet such that, when said foldable sheet is folded along a predetermined line to bring said first and second sections of said first side of said foldable sheet into face-to-face relationship, each of said contact pairs registers with one of said shorting contacts to effect a switch pair;

F) spacer means adapted to juxtapose said contact pairs and said shorting contacts of each said switch pair in a normally spaced-apart relationship to define a normally-open condition such that finger pressure applied to said second side of said foldable sheet above a given switch pair urges the contact pair of said given switch pair into conductive contact with the said shorting contact with which it registers, thereby effecting a momentary closure of the contact pair;

G) said printed circuit further including traces coupling all said contact pads comprising said contact pairs to decoder means, said decoder means being adapted to sense if a contact pair is closed and, if so, which contact pair;

H) at least one section of said second side of said foldable sheet having emplaced thereon a game board layout; and I) signal producing means coupled to said decoder means, said signal producing means being adapted to issue a predetermined sensible sequence in response to the detection by said decoder means that a specific contact pair has been momentarily closed.

93. The game board of claim 92 in which said game board layout includes indicia identifying the position of each underlying switch pair to be used in the performance of a game which can be played in accordance with said game board layout.

94. The game board of claim 92 in which:

A) a first section of said second side of said foldable sheet has emplaced thereon a first game board layout which includes indicia identifying the position of each underlying switch pair to be used in the performance of a game which can be played in accordance with said first game board layout; and B) a second section of said second side of said foldable sheet has emplaced thereon a second game board layout which includes indicia identifying the position of each underlying switch pair to be used in the performance of a game which can be played in accordance with said second game board layout;

such that a reversible game board is effected.

95. The game board of claim 94 in which said second section is bifurcated by a slot extending from the center of an edge of said second section to the center of said foldable sheet, thereby defining section halves, said slot being of sufficient width to facilitate a temporary fold along a centerline of said game board layout to render said game board more compact for storage, said edge of said second section being disposed parallel to the axis of said temporary fold.

96. The game board of claim 95 which further includes at least one stiffening substrate fixed to the one of said section halves which has no game board layout emplaced thereon.

97. The game board of claim 94 in which said game board layout is emplaced by direct printing on said one section of said second side of said foldable sheet.

98. The game board of claim 94 in which said first and second game board layouts are emplaced by overlaying said first and second sections of said second side of said foldable sheet with respective first and second pre-printed game board layouts.

99. The game board of claim 92 in which said second section is bifurcated by a slot extending from the center of an edge thereof to the center of said foldable sheet, thereby defining section halves, said slot being of sufficient width to facilitate a temporary fold along a centerline of said game board layout to render said game board more compact for storage, said edge of said second section being disposed parallel to the axis of said temporary fold.

100. The game board of claim 99 which further includes first and second stiffening substrates fixed, respectively, to said section halves.

101. The game board of claim 100 in which said decoder means and said signal producing means are incorporated into a control unit coupled to said printed circuit and in which said control unit is supported on an extension of one of said stiffening substrates.

102. The game board of claim 99 in which said game board layout is emplaced by overlaying said one section of said second side of said foldable sheet with a pre-printed game board layout.

103. The game board of claim 99 in which said foldable sheet is a sheet of paper.

104. The game board of claim 99 in which said foldable sheet is die cut.

105. The game board of claim 99 in which a plurality of said traces from said contact pairs terminate at a first connector and inputs to said decoder means are coupled to a second connector, said first and second connectors being electrically engaged to couple said plurality of traces to said decoder means.

106. The game board of claim 99 in which said first and second sections of said first side of said foldable sheet are joined with an adhesive.

107. The game board of claim 99 in which said signal producing means comprises:

A) a sound generator adapted to issue a predetermined audio drive signal sequence when said decoder detects that a given switch pair has been momentarily closed; and B) an audio transducer connected to and driven by said sound generator for audibly reproducing said signal sequence.

108. The game board of claim 92 in which said conductive printed circuit comprises conductive ink.

109. The game board of claim 108 in which said spacer means comprises a deposit of dielectric material disposed proximate said contact pairs and said shorting contacts of each switch pair, said deposit being of sufficient thickness to juxtapose a switch pair in said normally-open condition, said deposit being shaped so as to permit effecting a closure by finger pressure applied to said second side of said foldable sheet above a given switch pair, thereby flexing said contact pair of said given switch pair into a closure with said shorting contact of said given switch pair in a region in which said deposit is not present.

110. The game board of claim 109 in which said dielectric material comprises dielectric ink.

111. The game board of claim 109 in which said game board layout is emplaced by direct printing on said one section of said second side of said foldable sheet.

112. The game board of claim 109 in which said game board layout is emplaced by overlaying said one section of said second side of said foldable sheet with a pre-printed game board layout.

113. The game board of claim 109 in which said foldable sheet is a sheet of paper.

114. The game board of claim 109 in which said foldable sheet is die cut.

115. The game board of claim 109 in which a plurality of said traces from said contact pairs terminate at a first connector and inputs to said decoder means are coupled to a second connector, said first and second connectors being electrically engaged to couple said plurality of traces to said decoder means.

116. The game board of claim 109 in which said first and second sections of said first side of said foldable sheet are joined with an adhesive.

117. The game board of claim 109 in which said signal producing means comprises:

A) a sound generator adapted to issue a predetermined audio drive signal sequence when said decoder detects that a given switch pair has been momentarily closed; and B) an audio transducer connected to and driven by said sound generator for audibly reproducing said signal sequence.

* * * * *